US009954325B2

(12) United States Patent
Lee et al.

(10) Patent No.: US 9,954,325 B2
(45) Date of Patent: Apr. 24, 2018

(54) EARPHONE INTERFACE AND ELECTRONIC DEVICE INCLUDING THE SAME

(71) Applicant: Samsung Electronics Co., Ltd., Gyeonggi-do (KR)

(72) Inventors: Jun Hyuck Lee, Daegu (KR); Moon Hyuk Choi, Daegu (KR); Chul Hyung Yang, Gyeongsanbuk-do (KR); Ji Woo Lee, Gyeongsanbuk-do (KR)

(73) Assignee: Samsung Electronics Co., Ltd (KR)

( * ) Notice: Subject to any disclaimer, the term of this patent is extended or adjusted under 35 U.S.C. 154(b) by 0 days.

(21) Appl. No.: 15/404,935

(22) Filed: Jan. 12, 2017

(65) Prior Publication Data

US 2017/0310063 A1 Oct. 26, 2017

(30) Foreign Application Priority Data

Apr. 22, 2016 (KR) ..... 10-2016-0049500

(51) Int. Cl.

| | |
|---|---|
| ***H01R 24/58*** | (2011.01) |
| ***H01R 12/71*** | (2011.01) |
| ***H01R 13/66*** | (2006.01) |
| ***H04R 29/00*** | (2006.01) |

(52) U.S. Cl.

CPC ..... *H01R 24/58* (2013.01); *H01R 12/716* (2013.01); *H01R 13/6666* (2013.01); *H04R 29/001* (2013.01)

(58) Field of Classification Search

CPC .. H01R 24/58; H01R 12/716; H01R 13/6666; H04R 29/001

See application file for complete search history.

(56) References Cited

U.S. PATENT DOCUMENTS

| | | | |
|---|---|---|---|
| 6,549,089 | B2 | 4/2003 | Ashoka |
| 7,400,214 | B2 | 7/2008 | Storniolo et al. |
| 7,525,397 | B2 | 4/2009 | Schmidt |
| 8,369,813 | B2 | 2/2013 | Jeong et al. |
| 8,944,828 | B2 | 2/2015 | Tsao |
| 2003/0011442 | A1 | 1/2003 | Ashoka |
| 2006/0044075 | A1 | 3/2006 | Storniolo et al. |
| 2007/0296517 | A1 | 12/2007 | Schmidt |
| 2011/0045775 | A1 | 2/2011 | Jeong et al. |

(Continued)

FOREIGN PATENT DOCUMENTS

| | | |
|---|---|---|
| KR | 1020120099900 | 9/2012 |
| KR | 1020130008949 | 1/2013 |

*Primary Examiner* — Brenda C Bernardi

(74) *Attorney, Agent, or Firm* — The Farrell Law Firm, P.C.

(57) ABSTRACT

An electronic device is provided. The electronic device includes an earphone interface including a plug housing into which an earphone plug is inserted comprising contact points that contact electrode terminals of the earphone plug and protrusions connected to the contact points, and a substrate having signal lines coupled to the protrusions arranged in the plug housing to transmit signals to the electrode terminals of the earphone plug or receive signals from a specific electrode terminal. The substrate includes a ground line connected to a ground terminal of the earphone plug and a coupler that couples a wireless signal that flows through the ground line.

20 Claims, 25 Drawing Sheets

(56) References Cited

U.S. PATENT DOCUMENTS

| | | | | |
|---|---|---|---|---|
| 2013/0044034 | A1* | 2/2013 | Kim | H01Q 1/44<br>343/720 |
| 2014/0113491 | A1 | 4/2014 | Tsao | |
| 2017/0237840 | A1* | 8/2017 | Yun | H01R 24/58<br>455/550.1 |

* cited by examiner

EARPHONE INTERFACE AND ELECTRONIC DEVICE INCLUDING THE SAME

PRIORITY

This application claims priority under 35 U.S.C. § 119(a) to Korean Patent Application Serial No. 10-2016-0049500 which was filed on Apr. 22, 2016 in the Korean Intellectual Property Office, the entire disclosure of which is incorporated herein by reference.

BACKGROUND

1. Field of the Disclosure

The present disclosure generally relates to an electronic device, and more particularly, to an earphone interface of an electronic device.

2. Description of the Related Art

A conventional portable electronic device includes an earphone interface that supports an audio input/output function through connection of an earphone. Further, the conventional electronic device may utilize an earphone mounted on an earphone interface as an antenna related to a specific communication function.

When an earphone is used as an antenna in the electronic device, a signal received through the earphone is transferred to a hardware module related to processing of an audio signal and acts as noise. Furthermore, because an audio signal processing module and a multimedia broadcasting communication function may be connected to each other through a branch circuit, a signal may be lost by the branch circuit when audio is output. In addition, the design complexity of circuits and components is high due to circuit components included in the branch circuit and it is difficult to efficiently design within a confined space.

SUMMARY

The present disclosure has been made to address at least the above-mentioned problems and/or disadvantages and to provide at least the advantages described below. Accordingly, an aspect of the present disclosure is to provide an earphone interface that may reduce noise or interference of signals due to a signal received by an earphone.

In accordance with another aspect of the present disclosure, an earphone interface is provided. The earphone interface includes a plug housing into which an earphone plug is inserted and comprising contact points that contact electrode terminals of the earphone plug and protrusions that are connected to the contact points, and a substrate having signal lines that are coupled to the protrusions arranged in the plug housing to transmit signals to the electrode terminals of the earphone plug or receive signals from a specific electrode terminal, wherein the substrate comprises a ground line that is connected to a ground terminal of the earphone plug and a coupler that couples a wireless signal that flows through the ground line.

In accordance with another aspect of the present disclosure, an electronic device is provided. The electronic device includes an earphone interface comprising a plug housing comprising contact points that contact electrode terminals of the earphone plug and protrusions that are connected to the contact points, and a substrate comprising a ground line that is connected to a ground contact point of the plug housing, and a coupler that couples a wireless signal that flows through the ground line, an audio processing module that is electrically connected to the ground line and a wireless signal processing module that processes a wireless signal coupled by the coupler.

In accordance with another aspect of the present disclosure, an electronic device is provided. The electronic device includes an earphone interface that comprises contact points in contact with a plurality of electrode terminals of an earphone plug, a ground line that is connected to one of the contact points, which is connected to a ground terminal of the earphone plug, an audio processing module that is electrically connected to the ground line, a coupler that is arranged to be spaced apart from the ground line at an interval and a wireless signal processing module that is electrically connected to the coupler to process a wireless signal coupled by the coupler.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
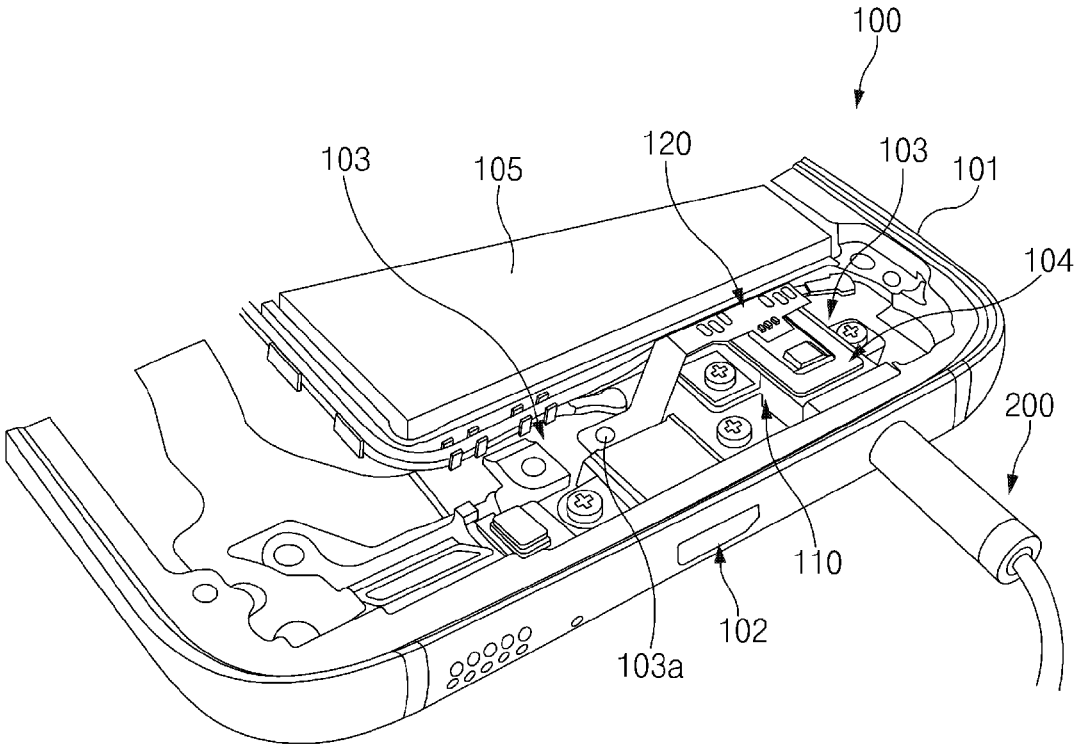
FIG. 1 is a view schematically illustrating a part of an electronic device, according to an embodiment of the present disclosure.

Various embodiments of the present disclosure may be described with reference to accompanying drawings. Accordingly, those of ordinary skill in the art will recognize that modification, equivalent, and/or alternative on the various embodiments described herein may be made without departing from the scope and spirit of the present disclosure. With regard to the description of the drawings, similar elements may be marked by similar reference numerals.

In the present disclosure, the expressions "have", "may have", "include" and "comprise", or "may include" and "may comprise" as used herein indicate existence of corresponding features (e.g., elements such as numeric values, functions, operations, or components) but do not exclude the presence of additional features.

In the present disclosure, the expressions "A or B", "at least one of A or/and B", or "one or more of A or/and B", and the like, as used herein may include any and all combinations of one or more of the associated listed items. For example, the terms "A or B", "at least one of A and B", or "at least one of A or B" may refer to all of the case (1) where at least one A is included, the case (2) where at least one B is included, or the case (3) where both of at least one A and at least one B are included.

Terms, such as "first", "second", and the like as used herein may refer to various elements of various embodiments, but do not limit the elements. Furthermore, such terms may be used to distinguish one element from another element. For example, "a first user device" and "a second user device" may indicate different user devices regardless of the order or priority thereof. For example, "a first user device" and "a second user device" may indicate different user devices.

It will be understood that when an element (e.g., a first element) is referred to as being "(operatively or communicatively) coupled with/to" or "connected to" another element (e.g., a second element), it may be directly coupled with/to or connected to the other element or an intervening element (e.g., a third element) may be present. In contrast, when an element (e.g., a first element) is referred to as being "directly coupled with/to" or "directly connected to" another element (e.g., a second element), it should be understood that there are no intervening elements (e.g., a third element).

According to the situation, the expression "configured to" as used herein may be used interchangeably with, for example, the expression "suitable for", "having the capacity to", "designed to", "adapted to", "made to", or "capable of". The term "configured to" does not mean only "specifically designed to" in hardware. Instead, the expression "a device configured to" may mean that the device is "capable of" operating together with another device or other components. A CPU, for example, a "processor configured to perform A, B, and C" may mean a dedicated processor (e.g., an embedded processor) for performing a corresponding operation or a general-purpose processor (e.g., a central processing unit (CPU) or an application processor) which may perform corresponding operations by executing one or more software programs which are stored in a memory device.

Terms used in the present disclosure are used to describe specified embodiments and do not limit the scope of the present disclosure. The terms of a singular form may include plural forms unless otherwise specified. Unless otherwise defined herein, all the terms used herein, which include technical or scientific terms, may have the same meaning that is generally understood by a person skilled in the art. It will be further understood that terms, which are defined in a dictionary and commonly used, should also be interpreted as is customary in the relevant related art and not in an idealized or overly formal manner unless expressly so defined herein in various embodiments of the present disclosure. In some cases, even if terms are defined in the specification, they may not be interpreted to exclude embodiments of the present disclosure.

An electronic device according to an embodiment of the present disclosure may include at least one of smartphones, tablet personal computers (PCs), mobile phones, video telephones, e-book readers, desktop PCs, laptop PCs, netbook computers, workstations, servers, personal digital assistants (PDAs), portable multimedia players (PMPs), motion picture experts group (MPEG-1 or MPEG-2) audio layer 3 (MP3) players, mobile medical devices, cameras, wearable devices (e.g., head-mounted-devices (HMDs), such as electronic glasses), an electronic apparel, electronic bracelets, electronic necklaces, electronic appcessories, electronic tattoos, smart watches, and the like.

According to an embodiment of the present disclosure, the electronic devices may be home appliances. The home appliances may include at least one of, for example, televisions (TVs), digital versatile disc (DVD) players, audio players, refrigerators, air conditioners, cleaners, ovens, microwave ovens, washing machines, air cleaners, set-top boxes, home automation control panels, security control panels, TV boxes (e.g., Samsung HomeSync™, Apple TV™, or Google TV™), game consoles (e.g., Xbox™ or PlayStation™), electronic dictionaries, electronic keys, camcorders, electronic picture frames, and the like.

According to an embodiment of the present disclosure, the electronic device may include at least one of medical devices (e.g., various portable medical measurement devices (e.g., a blood glucose monitoring device, a heartbeat measuring device, a blood pressure measuring device, a body temperature measuring device, and the like)), a magnetic resonance angiography (MRA), a magnetic resonance imaging (MRI), a computed tomography (CT), scanners, and ultrasonic devices, navigation devices, global positioning system (GPS) receivers, event data recorders (EDRs), flight data recorders (FDRs), vehicle infotainment devices, electronic equipment for vessels (e.g., navigation systems and gyrocompasses), avionics, security devices, head units for vehicles, industrial or home robots, automatic teller machines (ATMs), point of sales (POS) terminal, or Internet of Things (IoT) devices (e.g., light bulbs, various sensors, electric or gas meters, water sprinkler devices, fire alarms, thermostats, street lamps, toasters, exercise equipment, hot water tanks, heaters, boilers, and the like).

According to an embodiment of the present disclosure, the electronic device may include at least one of parts of furniture or buildings/structures, electronic boards, electronic signature receiving devices, projectors, or various measuring instruments (e.g., water meters, electricity meters, gas meters, or wave meters, and the like). The electronic device may be one of the above-described various devices or a combination thereof. An electronic device may be a flexible device. Furthermore, an electronic device is not limited to the above-described electronic devices and may include other electronic devices and new electronic devices according to the development of new technologies.

Hereinafter, an electronic device according to an embodiment of the present disclosure, may be described with reference to the accompanying drawings. The term "user" as used herein may refer to a person who uses an electronic device or may refer to a device (e.g., an artificial intelligence electronic device) that uses an electronic device.

FIG. 1 is a view schematically illustrating a part of an electronic device according to an embodiment of the present disclosure.

Referring to FIG. 1, the electronic device 100 includes a case 101, a wired interface 102, a first printed circuit board 103, an earphone interface 104 (or an ear jack assembly) that is electrically connected to the earphone 200 to transfer audio input/output signals of the earphone 200 and includes a ground line of the earphone 200, and a battery 105. In addition, the electronic device 100 may further include a speaker, a speaker hole through which an audio signal generated by the speaker is output, and an antenna related to a communication interface included in the electronic device 100. The electronic device 100 may further include a second printed circuit board on which a processor (for example, an application processor or a communication processor) related to execution of a communication function or an application is mounted.

At least a portion of a side wall of the case 101 of the electronic device 100 may be formed of a metallic material. In this case, at least a portion of the case 101 formed of a metallic material may function as an antenna of the electronic device 100. According to an embodiment of the present disclosure, the case 101 may include a speaker hole formed on a lateral side thereof. The case 101 may include a first opening that is formed on one side of the lateral side thereof and is related to the wired interface 102, and a second opening that is formed on an opposite side of the lateral side thereof and is related to the earphone interface 104. At least one opening related to the earphone interface 104 may have a diameter corresponding to the diameter of the earphone 200 that is inserted into the opening.

The first printed circuit board 103 may be fixed to one side of the case 101. The wired interface 102 and the earphone interface 104 may be seated on, and fixed to, the first printed circuit board 103. The first printed circuit board 103 may include at least one contact point that is electrically connected to the wired interface 102. The first printed circuit board 103 may include at least one contact point 103*a* that is electrically connected to the earphone interface 104. The first printed circuit board 103 may be electrically connected to the second printed circuit board through conductive lines such as a cable or other flexible printed circuit board.

According to an embodiment of the present disclosure, an audio processing module (for example, an audio hardware module) that processes an audio signal that is output through the earphone 200 connected through the earphone interface 104 may be mounted on the first printed circuit board 103 or the first printed circuit board 103 may be electrically connected to the audio processing module mounted on the second printed circuit board. The first printed circuit board 103 may be electrically connected (soldered and fixed onto the first printed circuit board 103) to a hardware processing module (for example, a communication module or a communication processor, a digital multimedia broadcasting (DMB) module (or a digital video broadcasting (DVB-H) module), and a frequency modulation (FM) radio module) that processes a wireless signal received through the earphone 200 connected through the earphone interface 104. The first printed circuit board 103 may be electrically connected to the earphone interface 104 (for example, a substrate 120 (or earphone substrate) on one side of the earphone interface 104).

The earphone interface 104 includes a plug housing 110 into which an earphone plug of the earphone 200 is inserted to be seated, and a substrate 120 that is coupled to one side of the plug housing 110.

Figure 2:
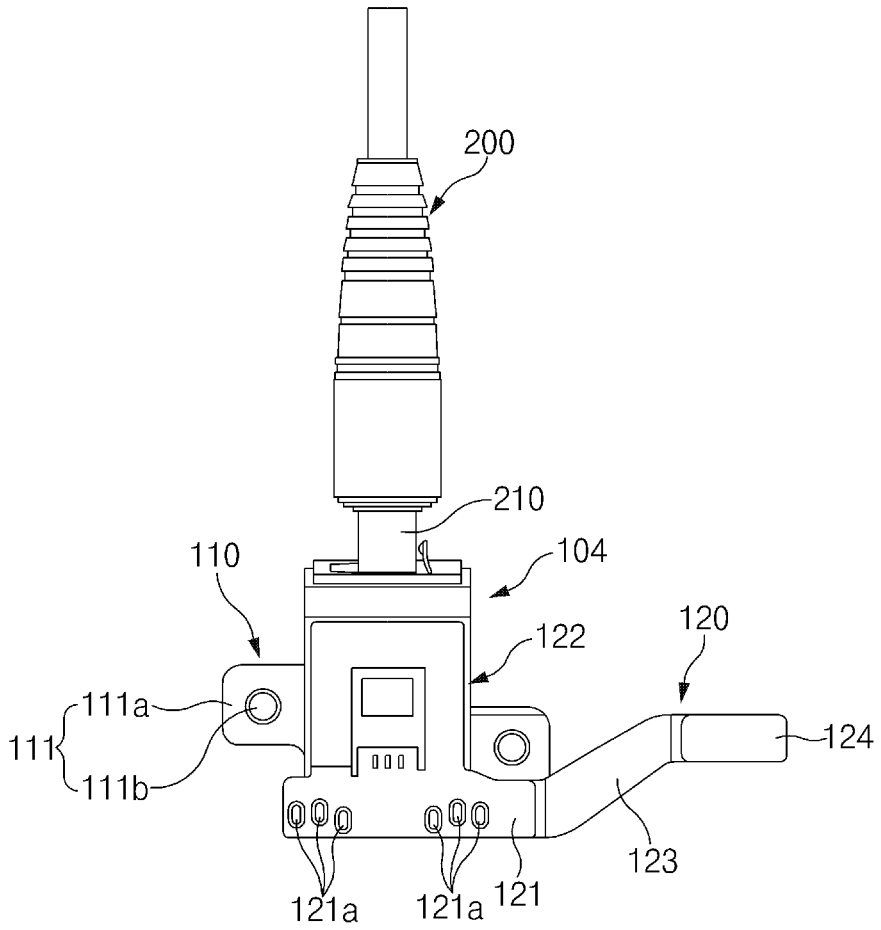
FIG. 2 is a view illustrating an earphone interface viewed from a first side, according to an embodiment of the present disclosure.

FIG. 2 is a view illustrating an earphone interface viewed from a first side, according to an embodiment of the present disclosure.

Figure 3:
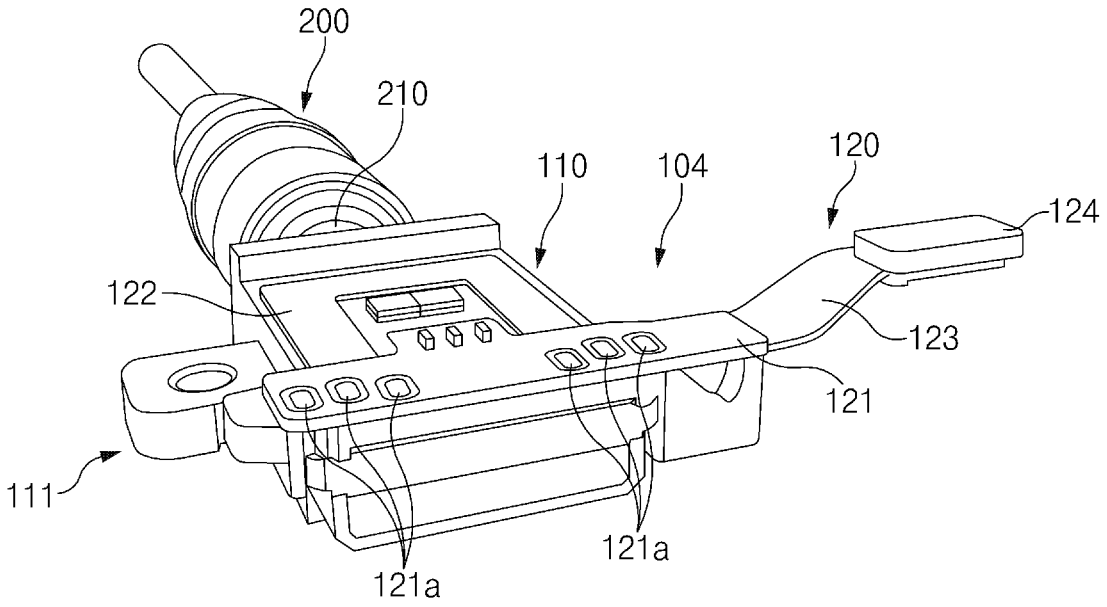
FIG. 3 is a view illustrating an earphone interface viewed from a second side, according to an embodiment of the present disclosure.

FIG. 3 is a view illustrating an earphone interface viewed from a second side, according to an embodiment of the present disclosure.

Figure 4:
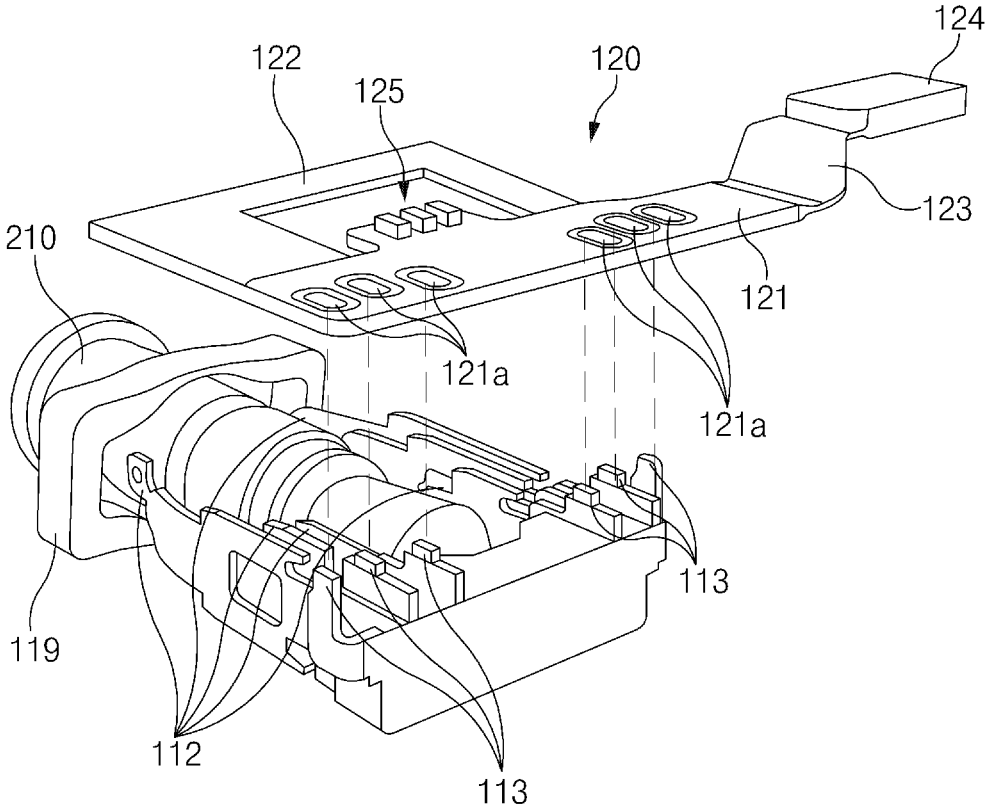
FIG. 4 is an exploded perspective view of an earphone interface, according to an embodiment of the present disclosure.

FIG. 4 is an exploded perspective view of an earphone interface, according to an embodiment of the present disclosure.

Figure 5:
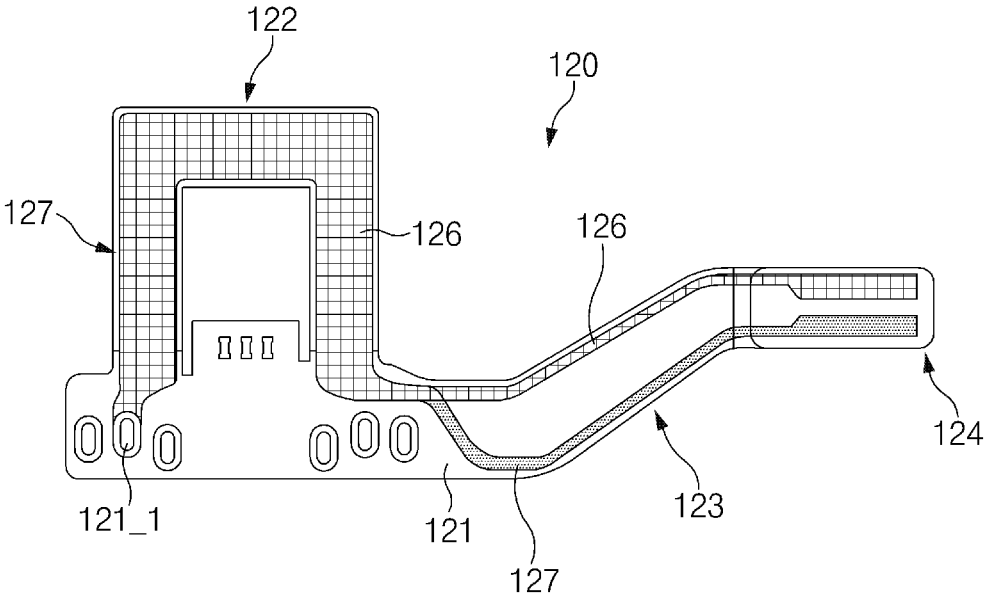
FIG. 5 is a view illustrating a substrate, according to an embodiment of the present disclosure.

FIG. 5 is a view illustrating a substrate, according to an embodiment of the present disclosure.

Referring to FIGS. 1 to 5, the earphone interface 104 may be fixed to one side of the first printed circuit board 103 or to one side of the case 101. Further, the earphone interface 104 may be fixed to the first printed circuit board 103 that is fixed to one side of the case 101. The earphone interface 104 may include a plug housing 110 that is electrically connected to an earphone plug 210 (or the earphone 200), and a substrate 120 that is electrically connected to at least a portion of the plug housing 110.

At least a portion of the plug housing 110 may have a shape or structure that surrounds the seated earphone plug 210. For example, the plug housing 110 may have a line or a conductive structure that electrically contacts the earphone plug 210, and a hole that includes a resin surrounding the line or the conductive structure and into which the earphone plug 210 is inserted. At least a portion of the plug housing 110 may include one or more contact points 112 that physically or electrically contacts a surface of the earphone plug 210 inserted through an opening area 119, and protrusions 113 that are electrically connected to the contact points 112 and are inserted into the holes formed in the substrate 120. The protrusions 113, and the holes into which the protrusions 113 are inserted, may be arranged in various forms including in parallel (or in a straight form) in a designated area to facilitate design of a coupler. At least a portion of the coupler may be formed of a conductive material, and may be arranged to be spaced apart from a signal line through which a signal flows by a specific distance to couple the signal flowing through the signal line (or may be synchronized with the signal line to copy or induce the same signal). The shape or arrangement of the contact points 112 of the plug housing 110 or the shape or arrangement of the protrusions 113 may be modified according to design. For example, the plug housing 110 may be modified according to the number of polarities of the inserted earphone 200, and the location, number, and shape (size or form) of the contact points 112 or the protrusions 113 may be modified according to the form of the earphone 200. An interface fixing part 111 may be arranged on one or multiple sides of the plug housing 110.

At least a portion of the opening area 119, for example, may have a form of a hole or a band having a specific size that the earphone plug 210 may be inserted into. Although the drawing illustrates a form in which the opening area 119 has a rectangular band shape and a central portion of the opening area is larger than a peripheral portion of the opening area, the present disclosure is not limited thereto. For example, the opening area 119 may have a circular band shape or a polygonal band shape. The opening area 119 may have a diameter that is similar to the diameter of the earphone plug 210 such that the inserted earphone plug 210 may not be easily withdrawn. Further, at least a portion of an inner side wall of the opening area 119 may be formed of a material (for example, rubber or plastic) that provides a frictional force when the earphone plug 210 is inserted or withdrawn.

As described above, the contact points 112 may be arranged to electrically or physically contact terminals of the earphone plug 210. For example, each of the contact points 112 may include an end that contacts a surface of the earphone plug 210, and a support that connects to the end of the contact point 112 to exert a resilient force while the end of the contact point 112 contacts the earphone plug 210. Protrusions 113 may be arranged at an end of the support. The contact points 112 may be arranged to have a specific gap between the contact points 112 such that they are in an electrically insulated state or are electrically insulated from each other.

The protrusions 113 may be connected to the contact points 112, and may be arranged in a specific direction (for example, in an upward direction as shown in FIG. 4) to electrically or physically couple to the substrate 120. The protrusions 113 may be arranged in parallel while having a specific spacing as illustrated. The heights of the protrusions 113 may be the same or similar. The protrusions 113 may be fixed through soldering and the like after being inserted into connection holes 121*a* provided in the substrate 120. The protrusions 113 may be arranged to have a specific spacing gap such that they are in an electrically insulated state or are electrically insulated from each other.

The interface fixing part 111 may fix the earphone interface 104 onto the first printed circuit board 103. The interface fixing part 111 may be provided on at least one side of the plug housing 110 to have a specific shape. For example, the interface fixing part 111 may include at least one flange 111*a* that has a shape protruding in parallel to the substrate 120 or from a surface of a side wall of the plug housing 110. For example, at least one screw insertion hole 111*b* may be provided inside the flange 111*a*.

The substrate 120 may include connection holes 121*a* (for example, holes into which the protrusions 113 may be inserted) that may be electrically connected to the protrusions 113 arranged in the plug housing 110, a ground line 126 that is electrically connected to a protrusion (for example, a protrusion that is electrically connected to a ground terminal of the earphone plug 210) of the protrusions 113, which is designed to receive a wireless signal, and a coupler 127 that is coupled to the ground line 126 to couple a wireless signal flowing through the ground line 126. The ground line 126 and the coupler 127 may be arranged at a specific interval. Further, the ground line 126 may be arranged in the same layer in which the coupler 127 is arranged and may be spaced apart from the coupler 127 at a specific interval. The ground line 126 may be arranged in a layer that is situated under or over the coupler 127.

The substrate 120 includes a contact point connecting area 121, a coupling extending area 122, a bending area 123, and a substrate connecting area 124.

The contact point connecting area 121 may have a specific thickness and a specific width. For example, the contact point connecting area 121 may be configured such that a lengthwise direction thereof is relatively long to cover the areas in which the protrusions 113 are arranged in parallel. One or more connection holes 121*a* may be arranged in the contact point connecting area 121. For example, the protrusions 113 may be inserted into the connection holes 121*a*, and the protrusions 113 may be fixed through soldering. The protrusions 113 may be fixed through various methods as well as soldering. For example, ends of the protrusions 113 may have a hook form, and may be hooked to the connection holes 121*a*. The contact point connecting area 121 may include lines that connect the connection holes 121*a* and an area (for example, an electrode pad) of the substrate connecting area 124. The lines may be provided in at least one of a plurality of layers of the substrate 120. According to various embodiments of the present disclosure, the contact point connecting area 121 may further include an overvoltage protection part 125 that restrains an overvoltage introduced through the earphone plug 210 or an overvoltage transferred to the earphone plug 210. The overvoltage protection part 125 may include a varistor (variable resistor). The overvoltage protection part 125 may be arranged in a space that is additionally provided on one side of the contact point connecting area 121. The protection part 125 may be formed in at least one of the plurality of layers that constitutes the contact point connecting area 121.

The coupling extending area 122 has a surface and a specific width, and may be arranged to connect a first side (for example, a left area of FIG. 5) of the contact point connecting area 121 and a second side (for example, a right area of FIG. 5). The coupling extending area 122 may be connected to a ground hole 121-1 (for example, a hole into which one of the protrusions 113, which is connected to a ground terminal of the earphone plug 210, is inserted) of the connection holes 121*a*, which is associated with the grounding. A portion of the ground line 126 may be arranged to detour the coupling extending area 122, and may be arranged on another point of the contact point connecting area 121, to which the coupling extending area 122 is connected, and the bending area 123, and the substrate connecting area 124.

An area of the ground line 126 that is arranged in the coupling extending area 122 may have a specific size or a designated pattern corresponding to the width and area of the coupling extending area 122. A plurality of layers may be provided in the coupling extending area 122. In this case, the ground line 126 may be provided in a specific layer (for example, the uppermost layer or the lowermost layer) of the plurality of layers. The coupling extending area 122 includes a coupler 127 that is coupled to the ground line 126. The coupler 127 has a shape that is similar to that of the ground line 126, and may be separated from the coupling extending area 122. Further, the coupler 127 may be arranged in the same layer in which the ground line 126 is arranged, and may be arranged adjacent to the ground line 126 at not more than a specific interval in the coupling extending area 122.

The bending area 123 may be arranged between the contact point connecting area 121 and the substrate connecting area 124. The bending area 123, for example, may be bent in a specific direction. A plurality of layers may be provided in the bending area 123. Lines connected to the connection holes 121*a* may be arranged in the plurality of layers of the bending area 123. Another area of the ground line 126 and another area of the coupler 127 may be arranged in any one of the plurality of layers of the bending area 123.

One side of the bending area 123 may be connected to the substrate connecting area 124, and an opposite side thereof may be connected to another configuration (for example, the first printed circuit board 103) of the electronic device 100. The substrate connecting area 124 may include electrode pads that are connected to the first printed circuit board 103. The electrode pads may include pads that are electrically connected to the connection holes 121*a*, and a pad that is electrically connected to the ground line 126 and the coupler 127. At least a portion of the substrate connecting area 124 may be of a rigid type.

According to various embodiments of the present disclosure, the contact point connecting area 121 may be of a rigid type, the bending area 123 may be of a flexible type, and the substrate connecting area 124 may be of a rigid type. At least a portion of the coupling extending area 122 may be of a rigid type or a flexible type. Although it is described that the substrate 120 is partially of a rigid or flexible type, the present disclosure is not limited thereto. For example, the entire earphone substrate 120 may be of a rigid type or a flexible type.

Although FIG. 5 illustrates that the ground line 126 and the coupler 127 may be identified from the outside, the ground line 126 and the coupler 127 may also be arranged in designated layers in the interior of the substrate.

If the earphone plug 210 of the earphone 200 is inserted into the plug housing 110, the earphone interface 104 may transfer a wireless signal received through the earphone 200, through the ground line 126 because a terminal of the earphone plug 210, for example, the ground terminal is electrically connected to the ground line 126. In addition, the coupler 127 may couple a wireless signal flowing through the ground line 126, and the wireless signal acquired by the coupler 127 may be transferred to the first printed circuit board 103 along a line formed in the bending area 123 and the substrate connecting area 124. Consequently, if a coupled wireless signal is transferred to the second printed circuit board (for example, a processor (such as an AP or a CP) to which the first printed circuit board 103 is electrically connected and a wireless signal processing module (for example, a main substrate in which a DMB module and the like are arranged), a module (for example, a DMB module) of the second printed circuit board may decode and output the wireless signal. The substrate 120 couples and transfers a wireless signal while providing a stable reference ground while performing the above-described function, and as a result, a wireless signal may be received and transferred while audio performance is not deteriorated when a signal (for example, a multimedia broadcasting signal) of a specific frequency band is received. Because the ground line 126 and the coupler 127 are arranged on the substrate 120 through the coupling extending area 122, the earphone interface 104 of the present disclosure may cover various frequency resonance characteristics of a broadcasting signal or a radio signal. Further, the earphone interface 104 of the present disclosure may support utilization of mounting space in the electronic device 100 that is simpler and optimized while having excellent frequency characteristics.

The electronic device according to an embodiment of the present disclosure may include an earphone interface including a ground line that is connected to a ground terminal of an earphone plug and a coupler that is spaced apart from the ground line at a specific interval to couple a wireless signal flowing through the ground line, and a wireless signal processing module that decodes the wireless signal coupled by the coupler. The earphone interface, for example, may include terminals corresponding to the electrode terminals of the earphone. For example, the earphone interface may include a microphone terminal, a left audio output terminal, a right audio output terminal, and a ground terminal in correspondence to a four pole earphone.

The earphone interface may include a plug housing into which the earphone plug is inserted and including contact points that contact the electrode terminals of the earphone plug and protrusions connected to the contact points, and a substrate that is coupled to the protrusions arranged in the plug housing and in which the ground line and the coupler are arranged.

According to embodiment of the present disclosure, the electronic device may further include at least one of an audio processing module including a ground area, an audio processing module of the ground line, or a processor that processes an output of a signal decoded by the wireless signal processing module.

Figure 6:
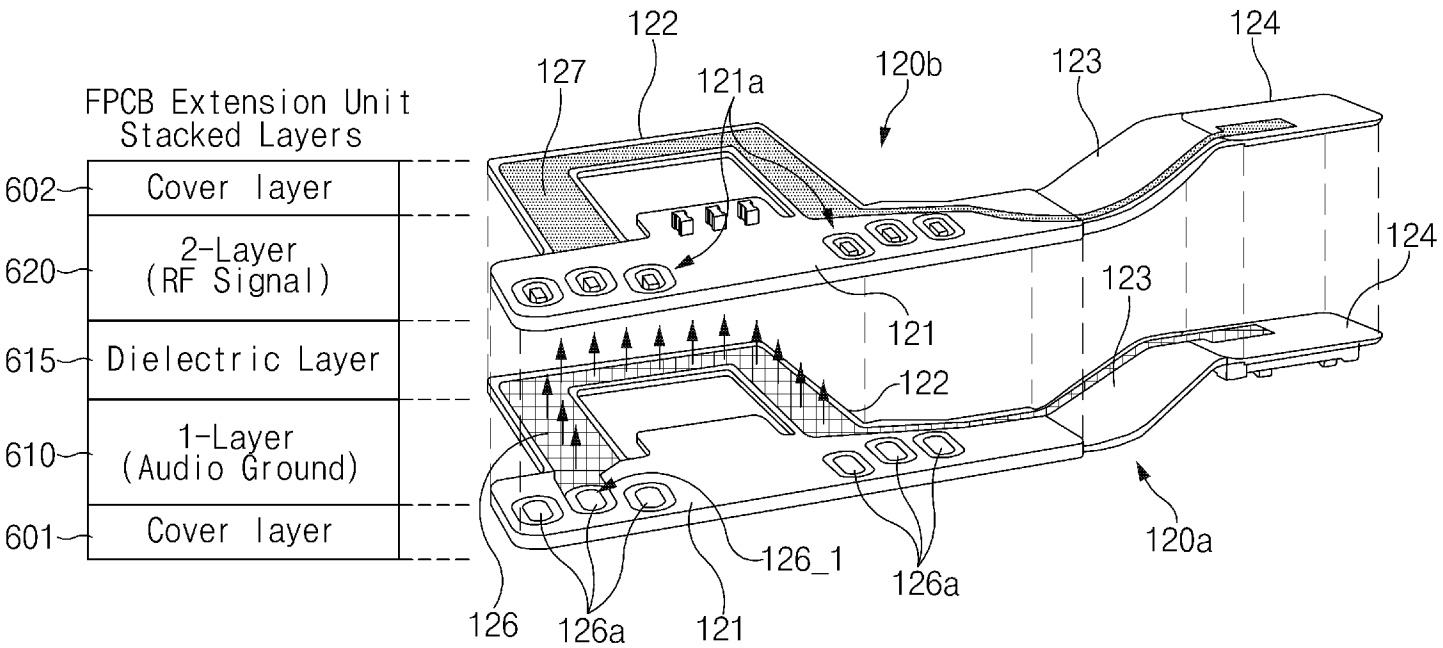
FIG. 6 is an exploded perspective view of a substrate, according to an embodiment of the present disclosure.

FIG. 6 is an exploded perspective view of a substrate according to an embodiment of the present disclosure.

Referring to FIG. 6, as illustrated in the left hierarchical view and the exploded perspective view, the substrate 120 includes a first substrate 120*a* (for example, a first cover layer 601 and a ground line layer 610), a dielectric layer 615, a second substrate 120*b* (for example, a coupler layer 620 and a second cover layer 602). As illustrated in FIGS. 3 to 5, the first substrate 120*a* and the second substrate 120*b* may be classified into a contact point connecting area 121, a coupling extending area 122, a bending area 123, and a substrate connecting area 124. The classification is made for convenience of description, and the substrate 120 may be a single substrate. The earphone substrate 120 may be simplified to describe a wireless signal receiving and transferring structure based on coupling. The earphone substrate 120 may further include a plurality of layers in which lines electrically connected to the connection holes 121*a* are arranged, and dielectric layers or insulating layers may be arranged between the plurality of layers.

The first cover layer 601 includes a layer of the first substrate 120*a*, which is arranged under the ground line layer 610. At least one layer is arranged under the ground line layer 610, and a layer of the at least one layer, which is arranged on the lowermost layer, may function as a protective layer for protecting the substrate 120 or an insulating layer for insulating the substrate 120. The first cover layer 601, for example, may be formed of a nonconductive material.

The ground line 610 includes a layer of the first substrate 120*a*, in which the ground line 126 is arranged. At least a portion of the ground line 126 may be arranged in at least one layer of the plurality of layers. For example, a portion of the ground line 126 may be arranged in the ground line layer 610, and another portion of the ground line 126 may be arranged in another layer. The ground line 126 may include a part of pads 126*a* related to the connection hole, which is connected to a ground pad 126_1 connected to a ground terminal, a part arranged on the coupling extending area 122, and a part connected to the contact point connecting area 121, the bending area 123, and the substrate connecting area 124. A portion (for example, a portion arranged in the coupling extending area 122) of the ground line 126 may have a size that is similar to the width or area of the coupling extending area 122. Further, a portion (for example, a part in which the contact point connecting area 121 and the bending area 123 are arranged) of the ground line 126 may have a shape having a relatively narrow width and a relatively long length. A portion (a part arranged in the substrate connecting area 124) of the ground line 126 may have a pad shape having a specific width and a specific area for connection to the first printed circuit board. An end (for example, a part having a pad shape) of the ground line 126 formed in the substrate connecting area 124 may be exposed to the outside through the lowermost layer or a surface layer to be connected to the first printed circuit board.

The dielectric layer 615 may be arranged between the first substrate 120*a* and the second substrate 120*b* to couple a wireless signal flowing through the ground line 126 to the coupler 127 while electrically insulating the ground line 126 and the coupler 127. Although it is illustrated that the dielectric layer 615 is one layer, the dielectric layer 615 may include a plurality of layers in which lines related to the connection holes are arranged and an insulation layer.

The coupler layer 620 may include a layer of the second substrate 120*b*, in which the coupler 127 is arranged. The coupler 127 arranged in the coupler layer 620 may be substantially similar to the ground line 126. For example, a part of the coupler 127, which is arranged in the coupling extending area 122 may be substantially the same as a part of the ground line 126, which is arranged in the coupling extending area 122. A part of the coupler 127, which is arranged in the bending area 123 and the substrate connecting area 124 may be arranged at a location that is different from a part of the ground line 126, which is arranged in the bending area 123 and the substrate connecting area 124. A part of the coupler 127, which is formed in the substrate connecting area 124, may have a pad shape having a specific width and a specific area, and may be exposed to the outside. The coupler 127 may couple a wireless signal flowing through the ground line 126 and transfer the coupled wireless signal to the first printed circuit board 103 while facing the ground line 126 with the dielectric layer 615 being interposed therebetween.

The second cover layer 602 may be arranged to cover an upper portion of the coupler layer 620 arranged in the second substrate 120*b*. At least part of the second cover layer 602 disposed in the substrate connecting area 124 may be removed such that at least one of the lines connected to the ground line 126, the coupler 127, and the connecting holes 121*a* is exposed.

Figure 7:
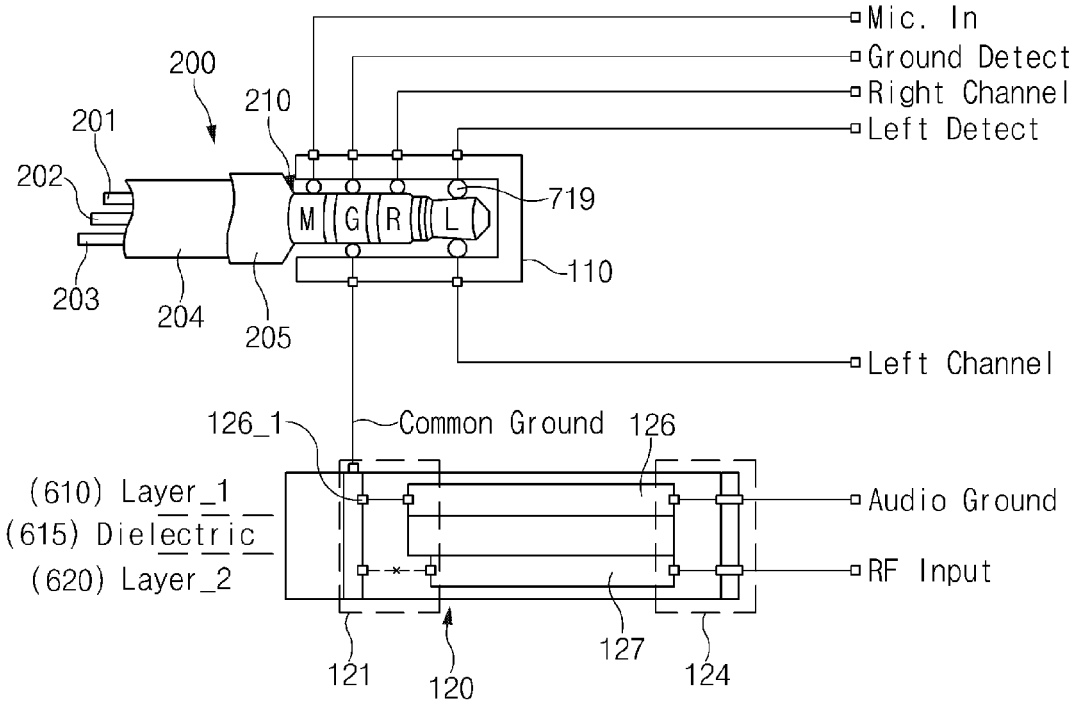
FIG. 7 is a view illustrating connection of an earphone interface and an earphone plug, according to an embodiment of the present disclosure.

FIG. 7 is a view illustrating connection of an earphone interface and an earphone plug, according to an embodiment of the present disclosure.

Referring to FIG. 7, the earphone 200 includes a right signal line 201, a left signal line 202, a microphone signal line 203, a ground signal line 204, a cable cover 205, and an earphone plug 210. The earphone plug 210 includes a left terminal L, a right terminal R, a ground terminal G, and a microphone terminal M.

The earphone interface 104 includes a plug housing 110 into which the earphone plug 210 is inserted to be seated, and a substrate 120. The plug housing 110 may include a left detection line (left detect) connected to a left terminal 1, a left channel line (left channel), a right channel line (right channel) connected to a right terminal r, a ground detection line (ground detect) connected to a ground terminal g, a ground line (common ground), and a microphone line (MIC). The plug housing 110 may include connection pins 719 that electrically connect terminals and lines of the earphone plug 210 while fixing the inserted earphone plug 210. The connection pins 719, for example, may correspond to the above-described contact points 112.

The ground line (common ground) may be electrically connected to the contact point connecting area 121 of the above-described earphone substrate 120. A plurality of layers may be provided in the contact point connecting area 121. The ground line (common ground) may be electrically connected to a specific point (for example, a ground pad 126_1) of a first layer (for example, a ground line layer 610 of the second substrate 120*b*) in the contact point connecting area 121, and accordingly, the ground line (common ground) may be electrically connected to a specific point of the substrate connecting area 124 through the ground line 126. A specific point of the substrate connecting area 124 may be connected to a ground (for example, audio ground) of a first hardware module (for example, an audio processing module).

The coupler 127 arranged in a second layer (for example, the coupler layer 620 of the second substrate 120*b*) of the contact point connecting area 121 may be arranged to face the first layer (for example, the first substrate 120*a*) while the dielectric layer 615 is interposed between the coupler 127 and the first layer, and may be electrically connected to a specific point (a point different from a point to which the ground line 126 is connected) of the substrate connecting area 124. A specific point of the substrate connecting area 124, to which the coupler 127 is connected, may be connected to an input terminal (such as a radio frequency (RF) input) of a second hardware module (for example, a wireless signal processing module).

As described above, a wireless signal introduced through the ground line (common ground) may be coupled by the coupler 127 while flowing through the ground line 126. The coupler 127 may transfer a wireless signal flowing through the ground line 126 to an input terminal of a hardware module (for example, a wireless signal processing module) of an electronic device connected to the substrate connecting area 124. During operation of the electronic device, the ground line 126 may also function as a ground of an audio processing module.

Figure 8:
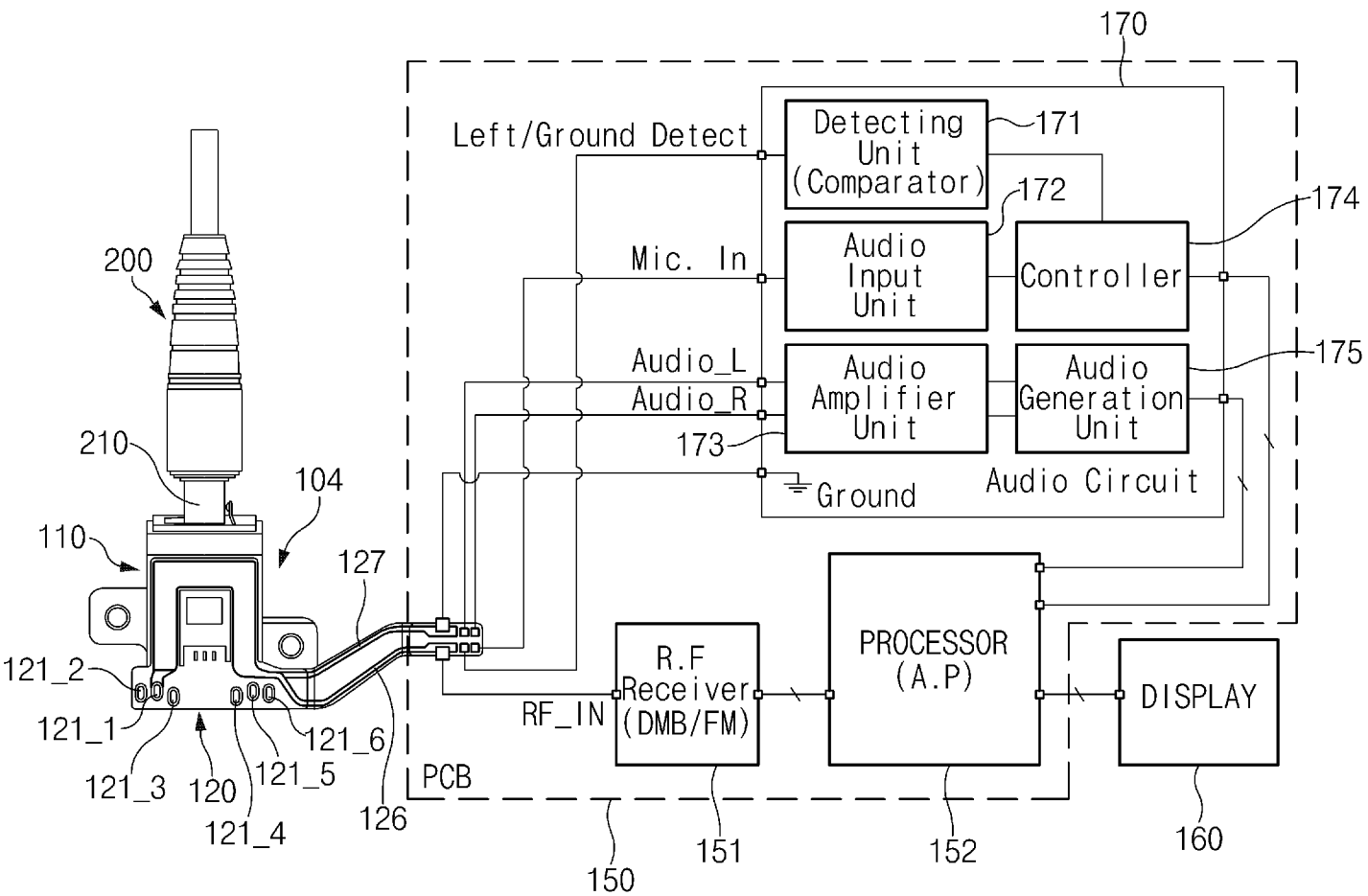
FIG. 8 is a view illustrating connection of an earphone interface into which an earphone is inserted and hardware modules of an electronic device, according to an embodiment of the present disclosure.

FIG. 8 is a view illustrating connection of an earphone interface into which an earphone is inserted and hardware modules of an electronic device according to an embodiment of the present disclosure.

Referring to FIG. 8, the earphone plug 210 of the earphone 200 may be electrically coupled to the contact points arranged in the plug housing 110 while being inserted into the plug housing 110 of the earphone interface 104.

The contact points arranged in the plug housing 110 of the earphone interface 104 may be connected to the plurality of connection holes 121*a*. The connection holes 121*a*, for example, may include a right channel hole 121_2, a ground hole 121_1, a left detection hole 121_3, a left channel hole 121_4, a microphone hole 121_5, and a ground detection hole 121_6. The ground line 126 corresponding to the ground hole 121_1 and electrically connected to the ground pad 126*a* arranged in the ground line layer 610, for example, may be connected to the substrate connecting area 124 through the ground line layer 610 of the first substrate 120*a*. The coupler 127 may be connected to the substrate connecting area 124 through the coupler layer 620 of the second substrate 120*b*.

The hardware modules of the electronic device, for example, may include a printed circuit board 150 on which at least one hardware module is mounted which may include a wireless signal processing module 150, a processor 152, and an audio processing module 170. Additionally or alternatively, the hardware module of the electronic device may further include a display 160. The display 160 may be connected to the processor 152, and may output a screen corresponding to a signal transferred by the processor 152.

The audio processing module 170 (or an audio processing circuit), for example, includes a detecting unit 171, an audio input unit 172, an audio amplifier unit 173, a controller 174, and an audio generation unit 175. The audio processing module 170 may generate an audio signal in response to a signal transferred by the processor 152, amplify the generated audio signal, and output the amplified audio signal to the earphone 200. Further, the audio processing module 170 may process a sound signal collected from a microphone terminal of the earphone 200, and may transfer the processed sound signal to the processor 152. The processor 152 may transmit the collected sound signal to another electronic device through a communication module or may store the collected sound signal in a memory. Further, the processor 152 may execute a function corresponding to the collected sound signal.

In the above-described hardware module, when the earphone 200 functions as an antenna, the wireless signal received through the earphone 200 may be introduced through the ground terminal G of the earphone plug 210, the ground line (common ground) (for example, a contact point and a protrusion of the plug housing 110 that electrically connects the ground hole 121_1) to the ground terminal G, the ground hole 121_1, and the ground line 126. If a wireless signal is introduced into the ground line 126, the wireless signal is coupled through the coupler 127 arranged to couple a wireless signal received in the ground line 126 and the coupled wireless signal may be transferred to the wireless signal processing module 151. The wireless signal processing module 151 may process the wireless signal in a frequency band, and the processed signal may be transferred to the processor 152. The processor 152 may transfer a sound signal to the audio processing module 170 or transfer a video signal to the display 160 according to the characteristics (for example, a sound signal or a video signal) of the processed signal. During the above-described operation, because a wireless signal introduced through a ground terminal is coupled through the ground line 126 and the coupler 127, and is transferred to the wireless signal processing module 151, the electronic device according to an embodiment of the present disclosure may support processing of a wireless signal without lowering audio quality (for example, without causing cross-talk) while maintaining a stable ground state of the audio processing module.

Figure 9:
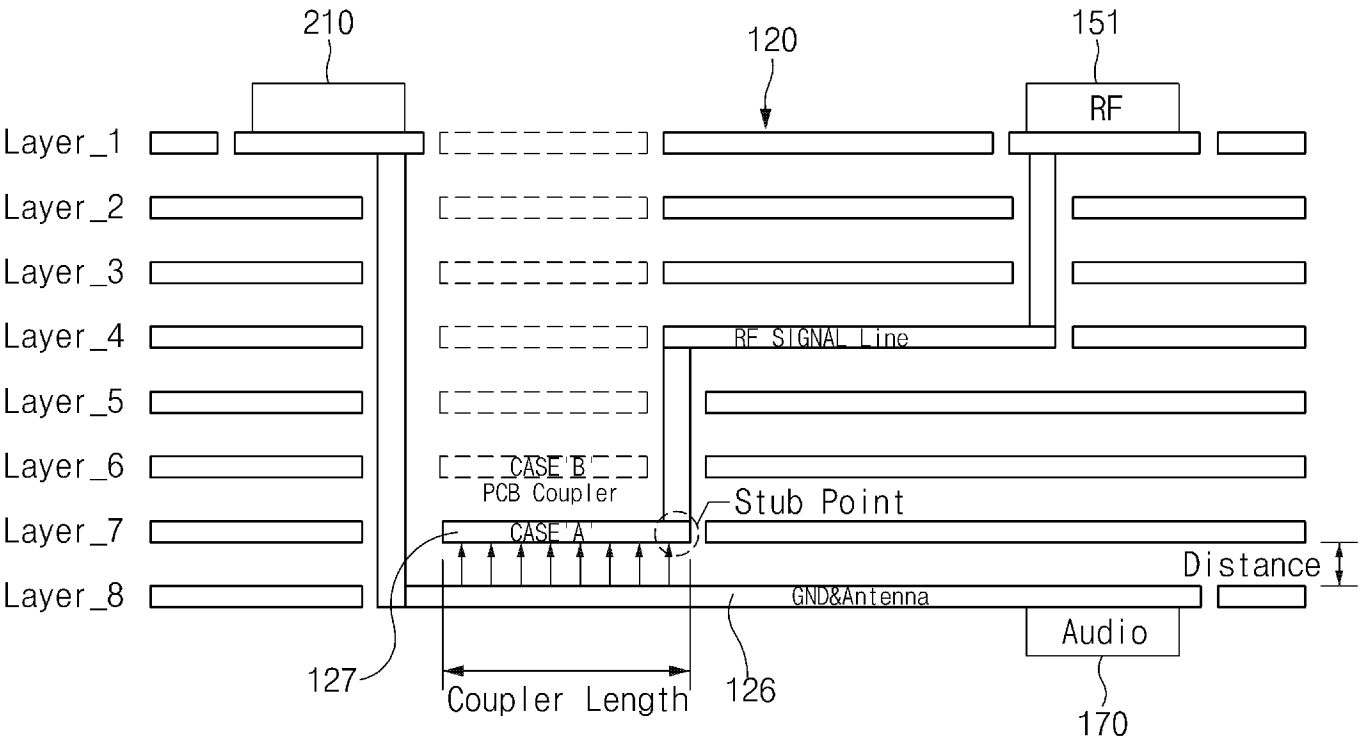
FIG. 9 is a view illustrating another substrate, according to an embodiment of the present disclosure.

FIG. 9 is a view illustrating another substrate according to an embodiment of the present disclosure.

Referring to FIG. 9, the substrate 120 has a plurality of layers as described above. Although it is illustrated in the drawing that the substrate 120 has eight layers, the present disclosure is not limited thereto. In FIG. 9, the layers may be layers in which at least some lines are arranged. Accordingly, insulating layers or dielectric layers are arranged between the layers, and the insulating layers or dielectric layers may electrically insulate the layers.

In FIG. 9, the substrate 120 includes a part (for example, a contact point connecting area) that is connected to the plug housing 110 directly connected to the earphone plug 210, and a part (for example, a coupling extending area) in which the ground line 126 and the coupler 127 are arranged. Further, the substrate 120 may include layers in which lines electrically connected to electrode terminals of the earphone plug 210 are arranged. The earphone plug 210, for example, may be at least one of an ear jack assembly form, a universal serial bus (USB) interface form, or other wired interface form (for example, a universal asynchronous receiver transmitter (UART)). In the following description, only an arrangement state of the ground line 126 and the coupler 127 will be described.

The ground line 126 includes a part that is electrically connected to a connection hole (for example, a hole related to a ground terminal of an earphone plug) of the connection holes which is arranged on one side of the contact point connecting area, a part that is arranged in the coupling extending area 122, a part that is arranged on an opposite side of the contact point connecting area 121, a part that is arranged in the bending area 123 and the substrate connecting area 124, and a part that is connected to a hardware module (for example, the audio processing module 170). A part of the ground line 126, which is arranged in the coupling extending area 122, may be arranged to face the coupler 127 while having a specific distance.

The coupler 127 includes a part that is arranged in the coupling extending area 122 on a seventh layer, a part (an RF signal line) that is arranged on a fourth layer, a part that connects the seventh layer and the fourth layer, and a part that is connected to a hardware module (for example, the wireless signal processing module 151). The part that connects the layers (for example, the seventh layer and the fourth layer) may be formed through a via hole that passes through the substrate. A section that couples a signal flowing through the ground line 126 of the coupler 127, for example, may extend to a stub point at which the seventh layer is branched to the fourth layer. Further, as described above, the coupling section may correspond to the length of the coupling extending area 122 that is provided to connect a first side and a second side of the contact point connecting area 121. Although it is shown in FIG. 9 that, after being connected to the fourth layer, the part arranged in the seventh layer of the coupler 127 is connected to the wireless signal processing module 151 arranged in the first layer, the present disclosure is not limited thereto. For example, the coupler 127 arranged in the seventh layer may be directly connected to the first layer without passing through the fourth layer.

Figure 10:
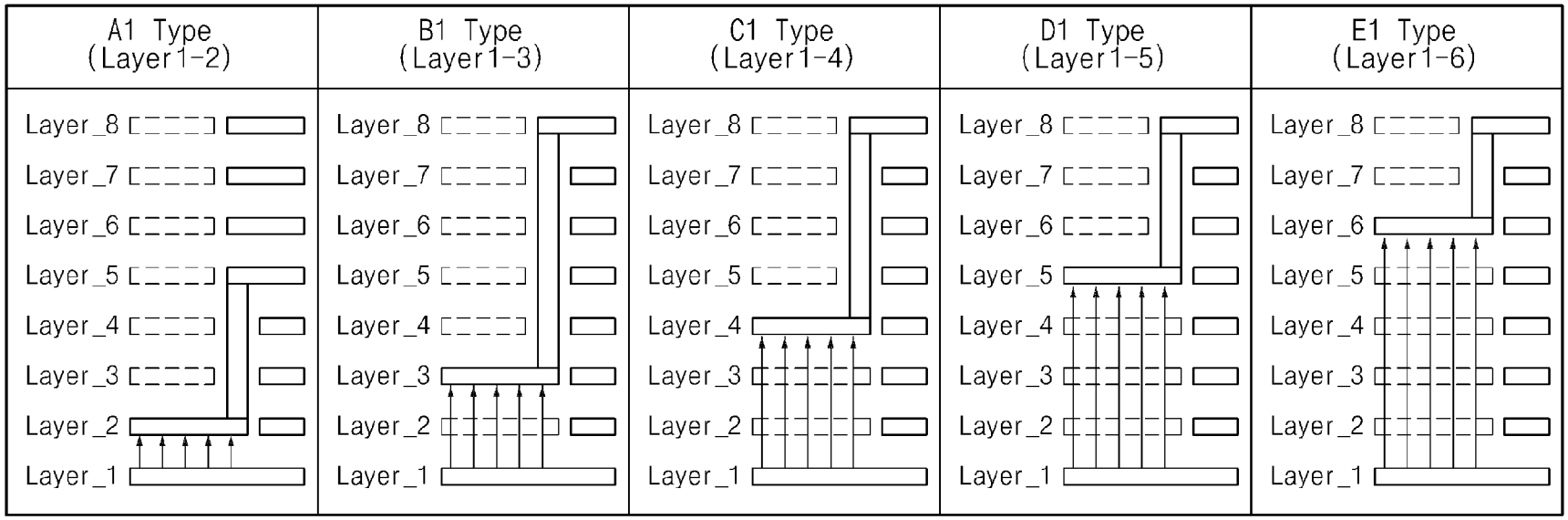
FIG. 10 is a view illustrating various locations of a coupler, according to an embodiment of the present disclosure.

FIG. 10 is a view illustrating various locations of the coupler according to an embodiment of the present disclosure.

Referring to FIG. 10, the coupler 127 according to an embodiment of the present disclosure, for example, may be of type A1, type B1, type C1, type D1, and type E1. In the types, a ground line is arranged in a designated layer, and a coupler may be arranged in another layer that is adjacent to the designated layer. The ground line, for example, may include a line (for example, a line to which a ground line is connected) through which a wireless signal received by the earphone 200 is transferred. The coupler may couple a signal flowing through a ground line while being spaced apart from the ground line at a specific interval, and the coupled signal may be transferred to a hardware module (for example, a wireless signal processing module).

Type A1, for example, may include a type in which a ground line and a coupler are arranged in the first layer and the second layer. In type A1, a ground line or a coupler may be arranged in the first layer, and a coupler or a ground line may be arranged in the second layer. Here, type A1 may include a state in which another layer is not arranged between the ground line and the coupler. Accordingly, type A1 may include an arrangement state of a ground line and a coupler in a structure in which another layer is not arranged between the second layer and the third layer or between the third layer and the fourth layer. Type B1, for example, may include a type in which a ground line and a coupler (or a coupler and a ground line) are arranged in the first layer and the third layer. Further, type B1 may include a form in which another layer is arranged between the layers. Type C1, for example, may include a type in which a ground line and a coupler (or a coupler and a ground line) are arranged in the first layer and the fourth layer. Further, type C1 may include a form in which other two layers are arranged between the layers. Type D1 may include a type in which a ground line and a coupler (or a coupler and a ground line) are arranged in the first layer and the fifth layer. Further, type D1 may include a form in which other three layers are arranged between the layers. Type E1 may include a type in which a ground line and a coupler (or a coupler and a ground line) are arranged in the first layer and the sixth layer. Further, type E1 may include a form in which other four layers are arranged between the layers. When a ground line and a coupler are arranged in the seventh and the eighth layer, respectively, it may correspond to type A1.

Figure 11:
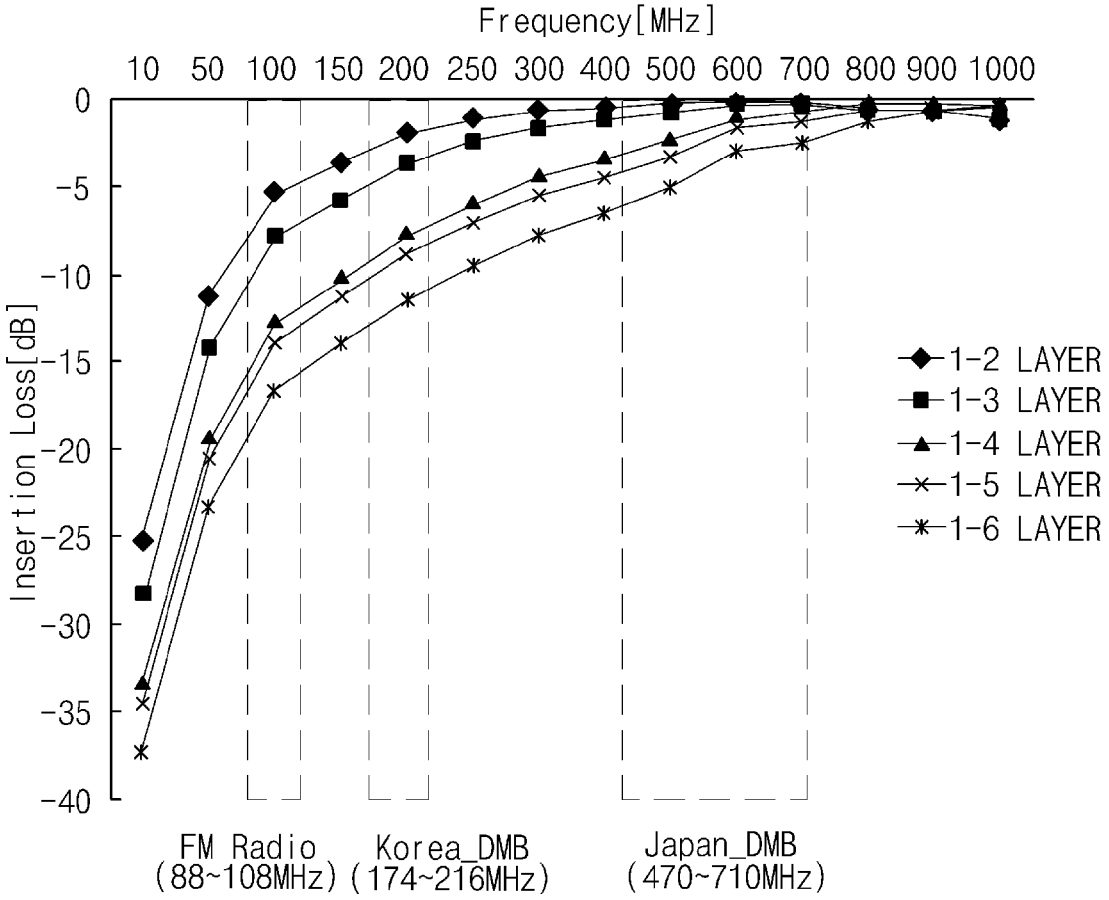
FIG. 11 is a view illustrating frequency characteristics according to an interval between the ground line and the coupler, according to an embodiment of the present disclosure.

FIG. 11 is a view illustrating frequency characteristics according to an interval between the ground line and the coupler, according to an embodiment of the present disclosure.

Referring to FIG. 11, the illustrated graph depicts insertion losses according to frequency, for shapes in which the ground line and the coupler are arranged while a specific interlayer interval is interposed therebetween. It may be seen that as the interlayer interval between the ground line and the coupler becomes larger, the insertion losses become higher. Further, it may be seen that the insertion loss is constant regardless of the interlayer interval in a specific frequency band. It may be seen that an influence of the interlayer interval on the insertion loss becomes greater in a low frequency band. Accordingly, when the electronic device includes a wireless signal processing module that utilizes the earphone 200 as an antenna, it may be relatively advantageous to minimize the interlayer interval between the ground line and the coupler.

Figure 12:
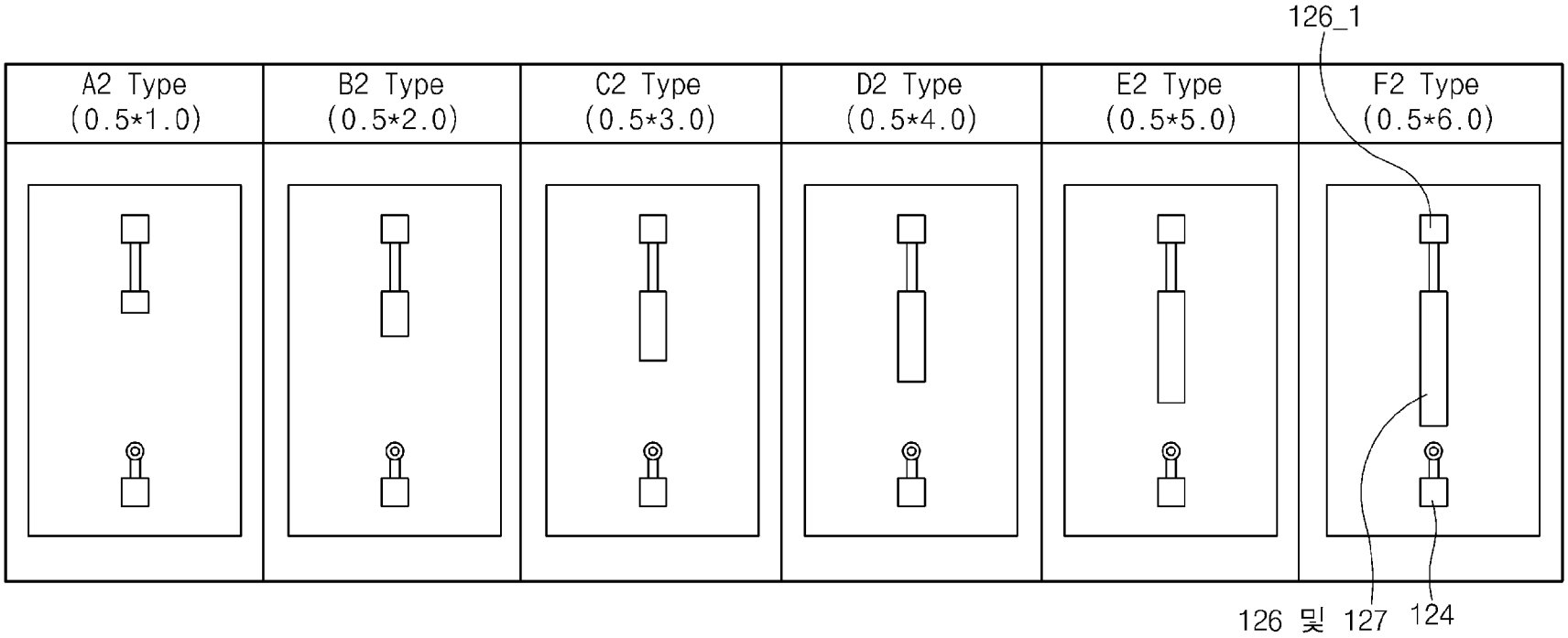
FIG. 12 is a view illustrating various lengths of the coupler, according to an embodiment of the present disclosure.

FIG. 12 is a view illustrating an example of various lengths of the coupler, according to an embodiment of the present disclosure.

Referring to FIG. 12, the earphone interface 104 includes a ground pad 126_1, a ground line 126, a coupler 127 that overlap and the ground line 126, and a substrate connecting area 124 in which the ground line 126 and the coupler 127 are connected to a printed circuit board. As described above, the types of couplers having various lengths may be couplers 127 that are arranged on the ground line 126 in the coupling extending area. The coupler 127, for example, may be formed to have a first length (for example, 0.5 (width)*1.0 (length) as in type A2. Further, the coupler 127 may have a second length (for example, 0.5 (width)*2.0 (length) as in type B2, have a third length (for example, 0.5 (width)*3.0 (length) as in type C2, have a fourth length (for example, 0.5 (width)*4.0 (length) as in type D2, have a fifth length (for example, 0.5 (width)*5.0 (length) as in type E2, and a sixth length (for example, 0.5 (width)*6.0 (length) as in type F2. The first length of type A2 may include a length that is smaller than the second length of type B2. The second length of type B2 may include a length that is smaller than the third length of type C. Similarly, the fourth length of type D2 is smaller than the fifth length of type E2, and the fifth length of type E2 may be smaller than the sixth length of type F2. The frequency characteristics according to the couplers having different lengths may be as illustrated in FIG. 13.

Figure 13:
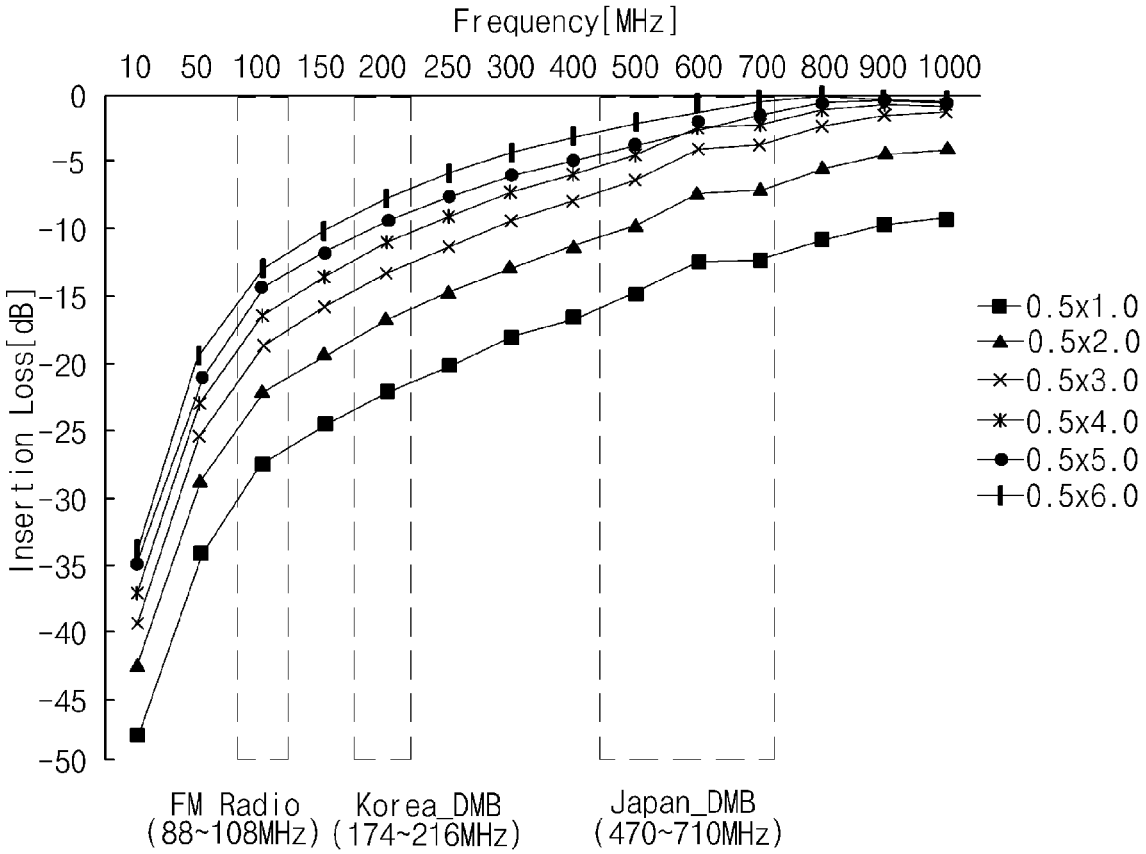
FIG. 13 is a view illustrating frequency characteristics according to lengths of the coupler, according to an embodiment of the present disclosure.

FIG. 13 is a view illustrating frequency characteristics for lengths of the coupler, according to an embodiment of the present disclosure.

Referring to FIG. 13, the graph depicts insertion losses according to frequency, for the lengths of the couplers. It may be seen in the graph that the insertion loss for frequency becomes lower as the length of the coupler becomes longer. Further, it may be seen that the difference between the losses for the lengths of the couplers increases at a given frequency band or higher (for example, not less than 88 MHz). Accordingly, when the electronic device includes a wireless signal processing module that utilizes the earphone 200 as an antenna, it may be relatively advantageous to increase the interlayer interval between the ground line and the coupler.

Figure 14:
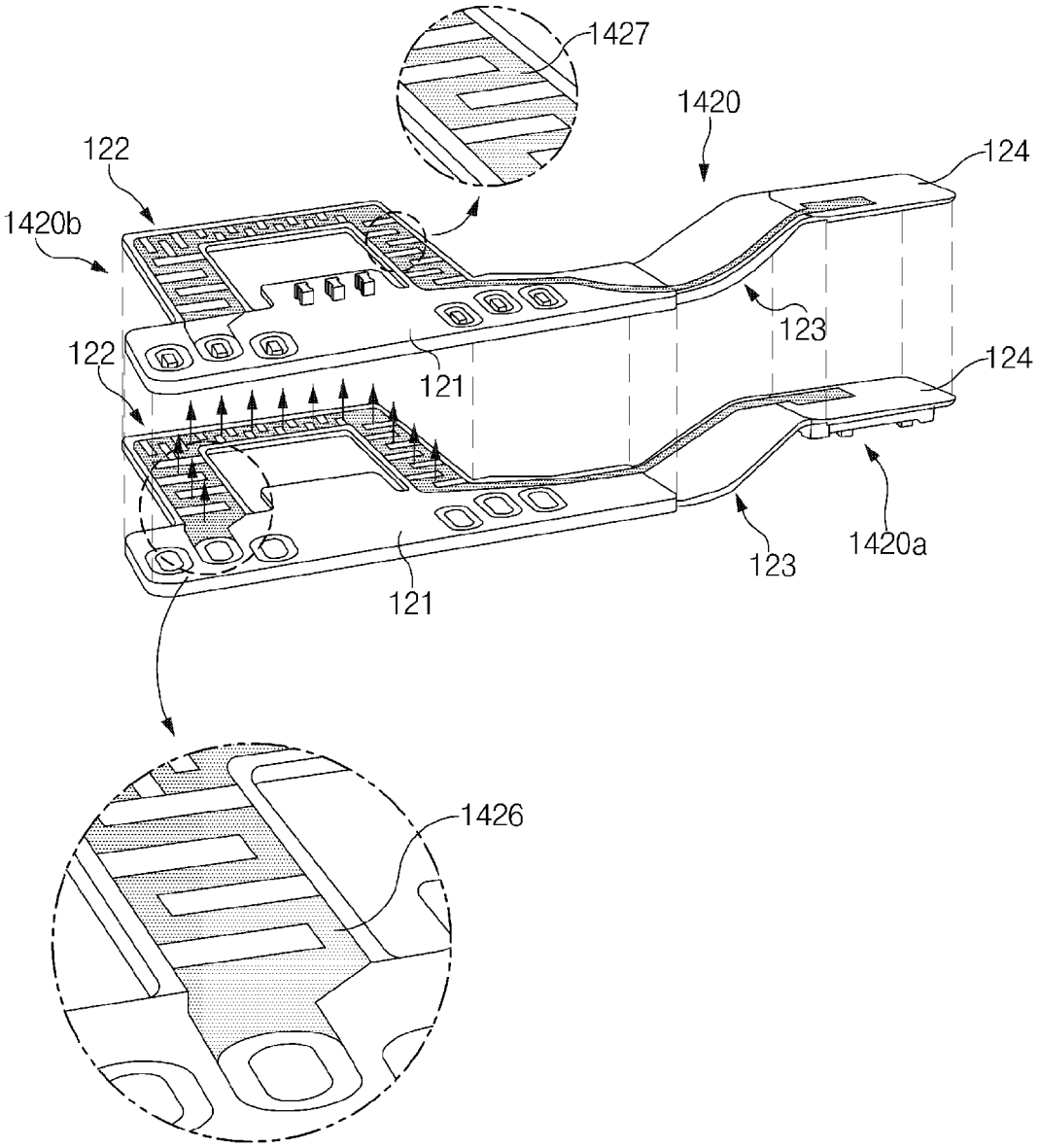
FIG. 14 is a view illustrating another substrate, according to an embodiment of the present disclosure.

FIG. 14 is a view illustrating another substrate according to an embodiment of the present disclosure.

Referring to FIG. 14, as described above, the substrate 1420 includes a contact point connecting area 121, a coupling extending area 122, a bending area 123, and a substrate connecting area 124. The contact connecting area 121, the bending area 123, and the substrate connecting area 124 may be substantially the same as or similar to the areas of the above-described earphone substrate.

A line pattern 1426 and a coupler pattern 1427 may be arranged in the coupling extending area 122. The line pattern 1426, for example, may be arranged in the ground line layer of the first substrate 1420*a*. The line pattern 1426 may have a form of a zigzag pattern as illustrated in FIG. 14. For example, the line pattern 1426 may have a horizontal zigzag pattern or a vertical zigzag pattern. The line pattern 1426, for example, may have the same width. The interval between the lines of the line pattern 1426 may be three times as large as the line width of the line pattern.

The coupler pattern 1427, for example, may be arranged in the coupler layer of the second substrate 1420*b*. The coupler pattern 1427 may have a form of a zigzag pattern as illustrated. For example, the coupler pattern 1427 may have the same pattern as the line pattern 1426. The coupler pattern 1427 may be arranged parallel with respect to the line pattern 1426. The coupler pattern 1427 may be arranged upwards or downwards with respect to the line pattern 1426. For example, when being observed form the upper side of the substrate 120 to the lower side, at least a portion (or the entire part) of the line pattern 1426 may overlap each other.

Figure 15:
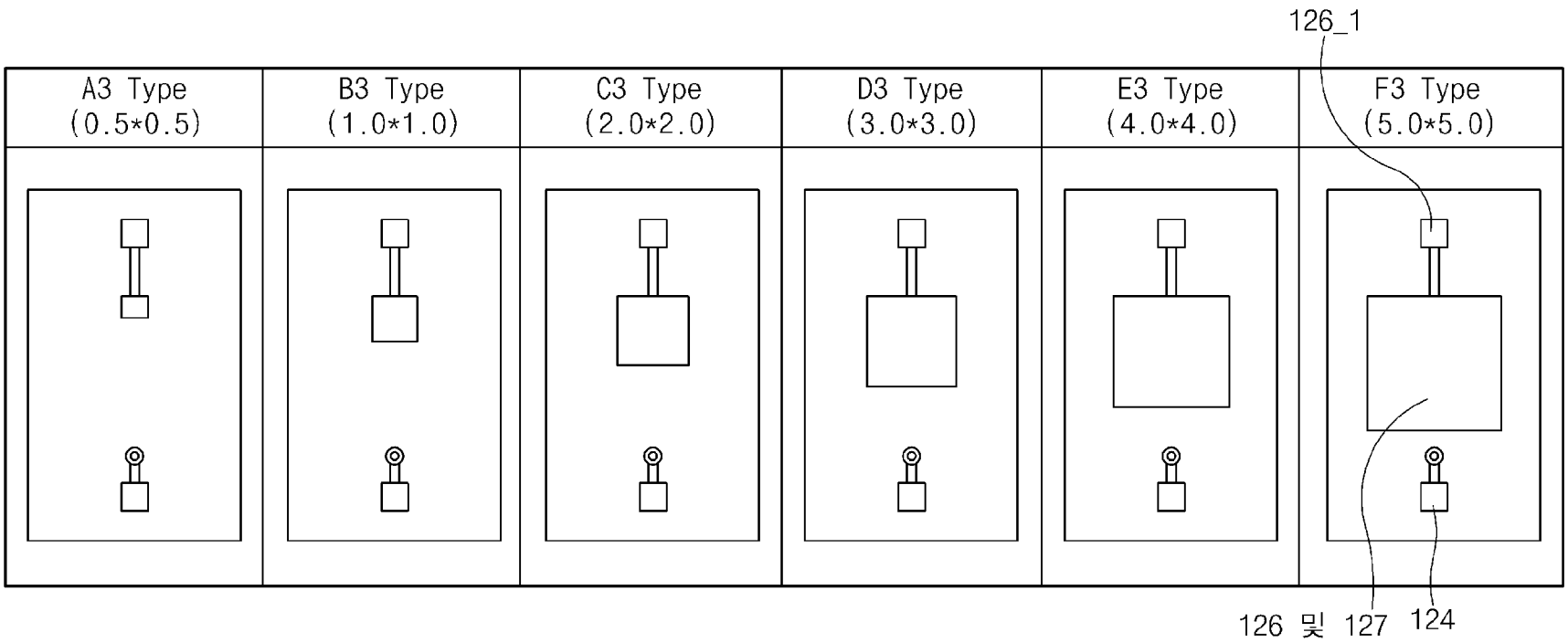
FIG. 15 is a view illustrating various areas of the coupler, according to an embodiment of the present disclosure.

FIG. 15 is a view illustrating various areas of the coupler according to an embodiment of the present disclosure.

Referring to FIG. 15, the earphone interface 104 includes a ground pad 126_1, a ground line 126, a coupler 127 that overlap and the ground line 126, and a substrate connecting area 124 in which the ground line 126 and the coupler 127 are connected to a printed circuit board. The types of the couplers having various areas may be couplers that are arranged on the ground line in the coupling extending area. The coupler, for example, may have a first area (for example, 0.5 (first side)*0.5 (second side) as in type A3. Further, the coupler may have a second area (for example, 1.0 (first side)*1.0 (second side) as in type B3, have a third area (for example, 2.0 (first side)*2.0 (second side) as in type C3, have a fourth area (for example, 3.0 (first side)*3.0 (second side) as in type D3, have a fifth area (for example, 4.0 (first side)*4.0 (second side) as in type E3, and have a sixth area (for example, 5.0 (first side)*5.0 (second side) as in type F3. The first area of type A3 may include the smallest area as compared with other types of areas. The third area of type C3 or the fourth area of type D3, for example, may have an area that corresponds to a middle size as compared with the other types. The sixth area of type F3 may have the largest area as compared with the other types. The frequency characteristics according to the couplers having different areas may be as illustrated in FIG. 16.

Figure 16:
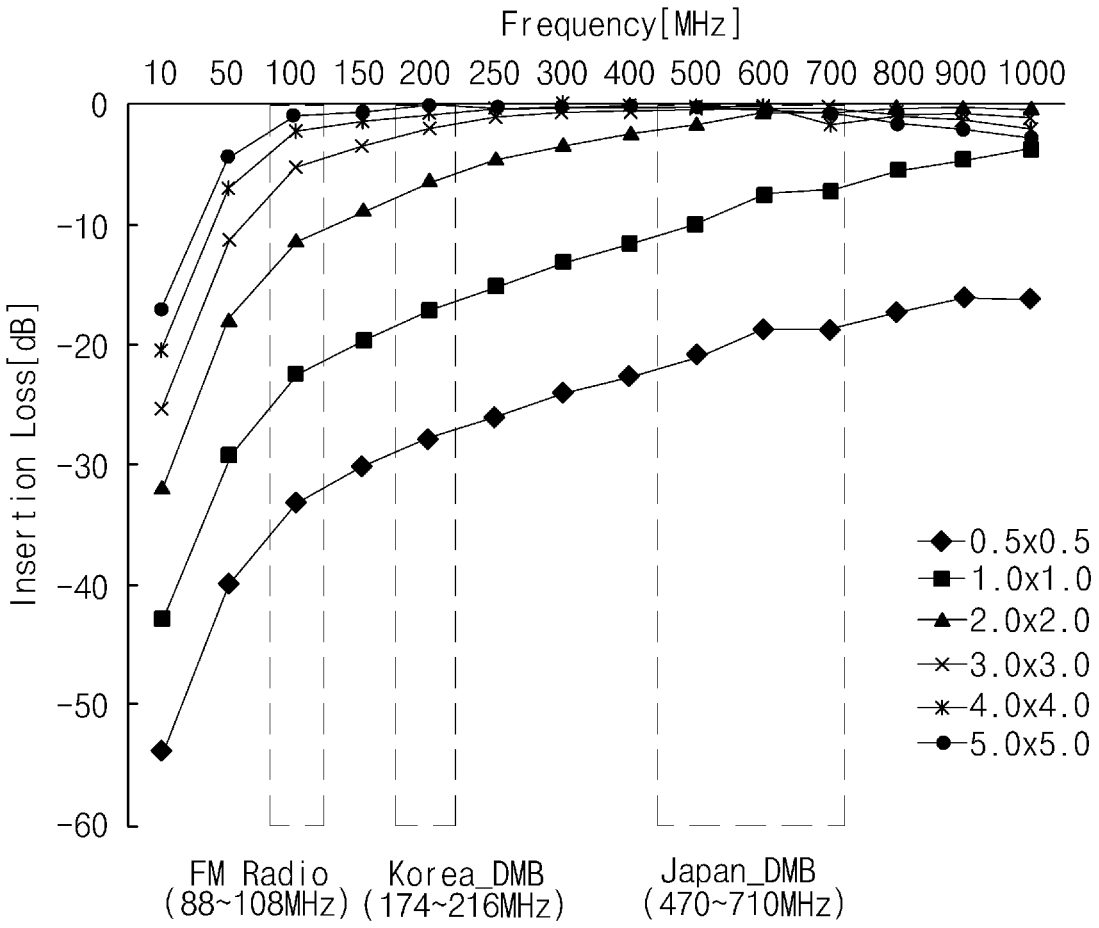
FIG. 16 is a view illustrating frequency characteristics according to areas of the coupler, according to an embodiment of the present disclosure.

FIG. 16 is a view illustrating frequency characteristics according to areas of the coupler according to an embodiment of the present disclosure.

Referring to FIG. 16, the graph depicts insertion losses according to frequency, and according to the areas of the couplers. It may be seen in the graph that the insertion loss for frequency becomes higher as the area of the coupler becomes smaller. It may be seen that the difference between the insertion losses for the areas of the couplers (for example, the areas of type A3, type B3, or type C3) having not more than a specific size is large. It may be seen that the difference of insertion losses for the frequencies between the areas of the couplers of type D3, type E3, and type F3 is relatively small. It may be seen from the graph that the coupler related to processing of wireless signals of a specific frequency band (for example, not less than 88 MHz to 700 MHz) has an area of not less than a specific size. For example, it may be seen that the coupler related to processing of a wireless signal of 470 MHz to 710 MHz shows a constant insertion loss regardless of the difference of the areas. Accordingly, it may be preferable that the coupler having an area of C3 or D3 be employed in the corresponding frequency band.

Figure 17A:
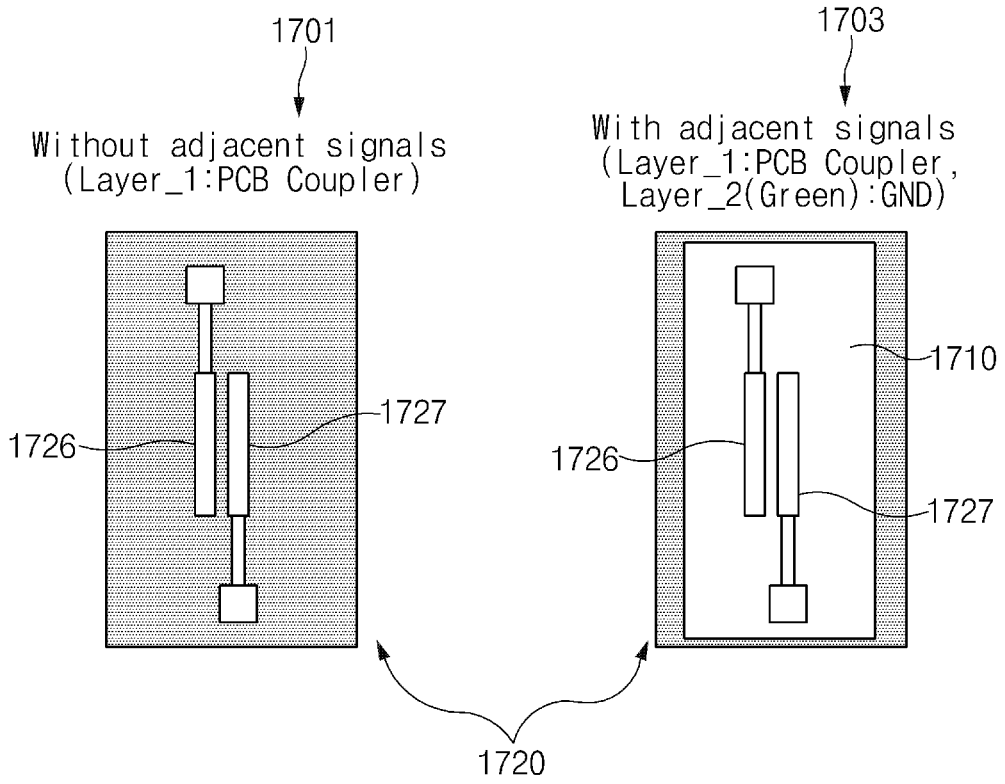
FIG. 17A is a view illustrating another structure of a ground line and a coupler, according to an embodiment of the present disclosure.

FIG. 17A is a view illustrating another structure of a ground line and a coupler, according to an embodiment of the present disclosure.

Figure 17B:
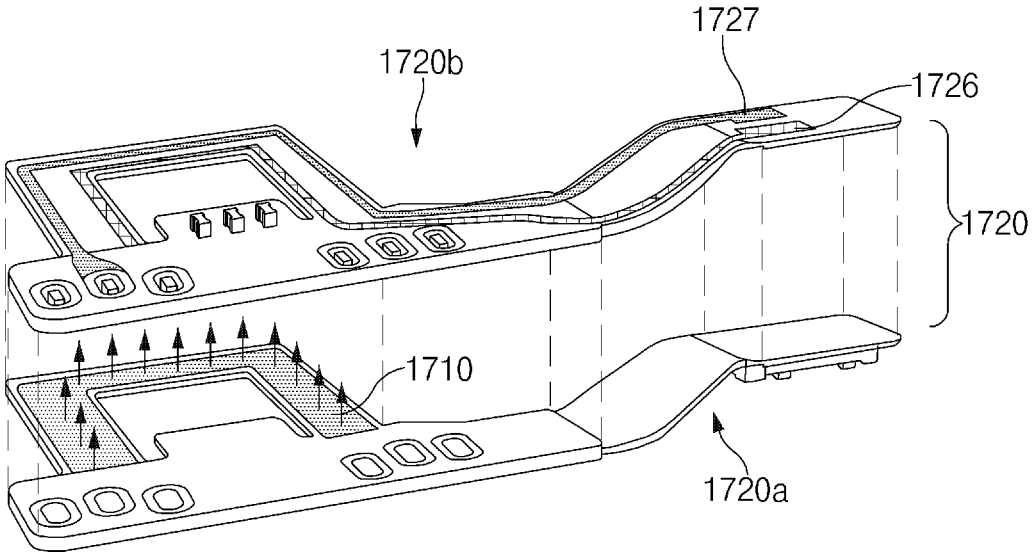
FIG. 17B is a view illustrating a substrate to which the ground line and the coupler are applied, according to an embodiment of the present disclosure.

FIG. 17B is a view illustrating a substrate to which the ground line and the coupler are applied, according to an embodiment of the present disclosure.

Referring to FIGS. 17A and 17B, the ground line 1716 and the coupler 1727 may be arranged in the same layer in the substrate 1720, according to an embodiment of the present disclosure. Although it is illustrated in FIGS. 17A and 17B as an example that the ground layer 1726 and the coupler 1727 are arranged in the uppermost layer (for example, a first layer) and a conductive layer is arranged in the second uppermost layer (for example, a second layer), other embodiments also are possible. For example, the ground line 1726 and the coupler 1727 may be disposed in the same layer of the eighth layer or the seventh layer.

According to an embodiment of the present disclosure, the ground line 1726 and the coupler 1727 may be arranged in the same layer while a separate layer is not formed under the layer as in state 1701. An interval between the ground line 1726 and the coupler 1727 may be determined such that a signal flowing through the ground line 1726 is coupled by the coupler 1727. The ground line 1726 and the coupler 1727 may have the same width. The ground line 1726 and the coupler 1727 may have substantially the same length. The interval between the ground line 1726 and the coupler 1727 may be not more than three times as large as the widths of the ground line 1726 and the coupler 1727. Further, the interval between the ground line 1726 and the coupler 1727 formed on the same layer may be changed according to a target frequency band. The coupling structure as in state 1701 may be formed, for example, on the eighth layer, which is the lowermost layer, when the substrate 1720 has eight layers.

According to an embodiment of the present disclosure, the coupling structure of the substrate 1720, for example, includes a ground line 1726 and a coupler 1727, and a conductive layer 1710 that is arranged under a layer in which the ground line 1726 and the coupler 1727 are formed as in state 1703. For example, when the ground line 1726 and the coupler 1727 are formed in the seventh layer, the conductive layer 1710 may be arranged in the eight layer. Further, as illustrated, the ground line 1726 and the coupler 1727 may be formed in the second substrate 1720*b*, and the conductive layer 1710 may be formed in the first substrate 1720*a*. The conductive layer 1710 may be formed only in the coupling extending area.

Figure 18:
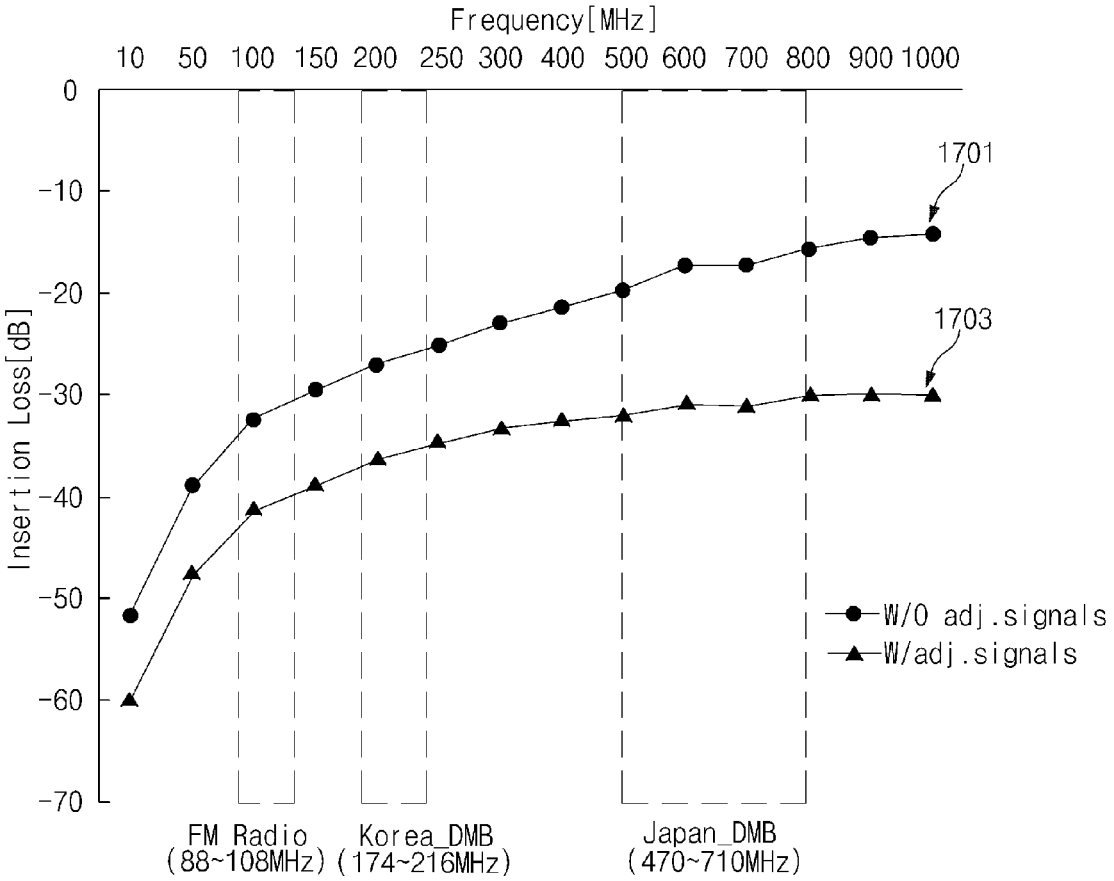
FIG. 18 is a view illustrating frequency characteristics according to inclusion of a conductive layer, according to an embodiment of the present disclosure.

FIG. 18 is a view illustrating frequency characteristics according to inclusion of a conductive layer, according to an embodiment of the present disclosure.

Referring to FIG. 18, it may be seen that the insertion losses for frequencies of structure 1701 (for example, a structure from which a conductive layer 1710 is excluded) described in FIG. 17 A is higher than that of structure 1703 (for example, a structure in which a conductive layer 1710 is arranged). Based on the result, it may be estimated that the conductive layer 1710 may act as a factor that reduces coupling between the ground line 126 and the coupler 127. Accordingly, it may be advantageous to employ structure 1701 (a structure in which the ground line 126 and the coupler 127 are arranged in the eighth layer) from which the conductive layer 1710 is excluded in an aspect of a relatively low insertion loss.

Figure 19A:
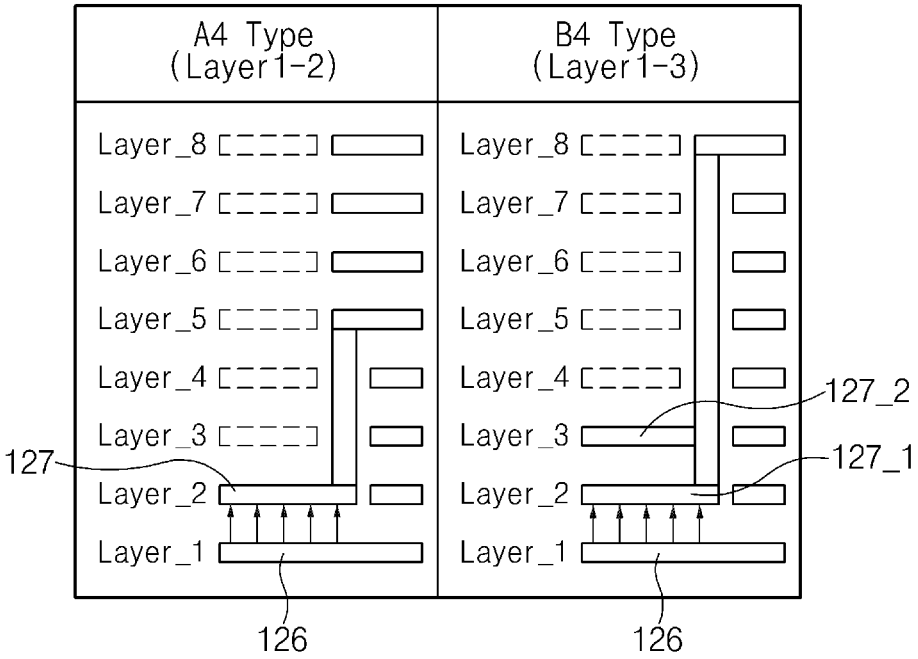
FIG. 19A is a view illustrating a structure of a multi-stepped coupler, according to an embodiment of the present disclosure.

FIG. 19A is a view illustrating an example of a structure of a multi-stepped coupler, according to an embodiment of the present disclosure.

Referring to FIG. 19A, the substrate may be configured as in type A4 such that the ground line 126 is arranged in the first layer and the coupler 127 is arranged in the second layer. Meanwhile, the substrate may be configured as in type B4 such that the ground line 126 is arranged in the first layer, the first coupler 127 is arranged in the second layer, and the second coupler 127 is arranged in the third layer. The first coupler 127 and the second coupler 127 may couple a wireless signal flowing through the ground line 126, and may transfer the coupled signal to a wireless signal processing module. In this regard, the first coupler 127 and the second coupler 127 may be connected to the first printed circuit board 103 through the substrate connecting area. The insertion losses of the coupling structures having the structure of FIG. 19A are as in FIG. 19B.

Figure 19B:
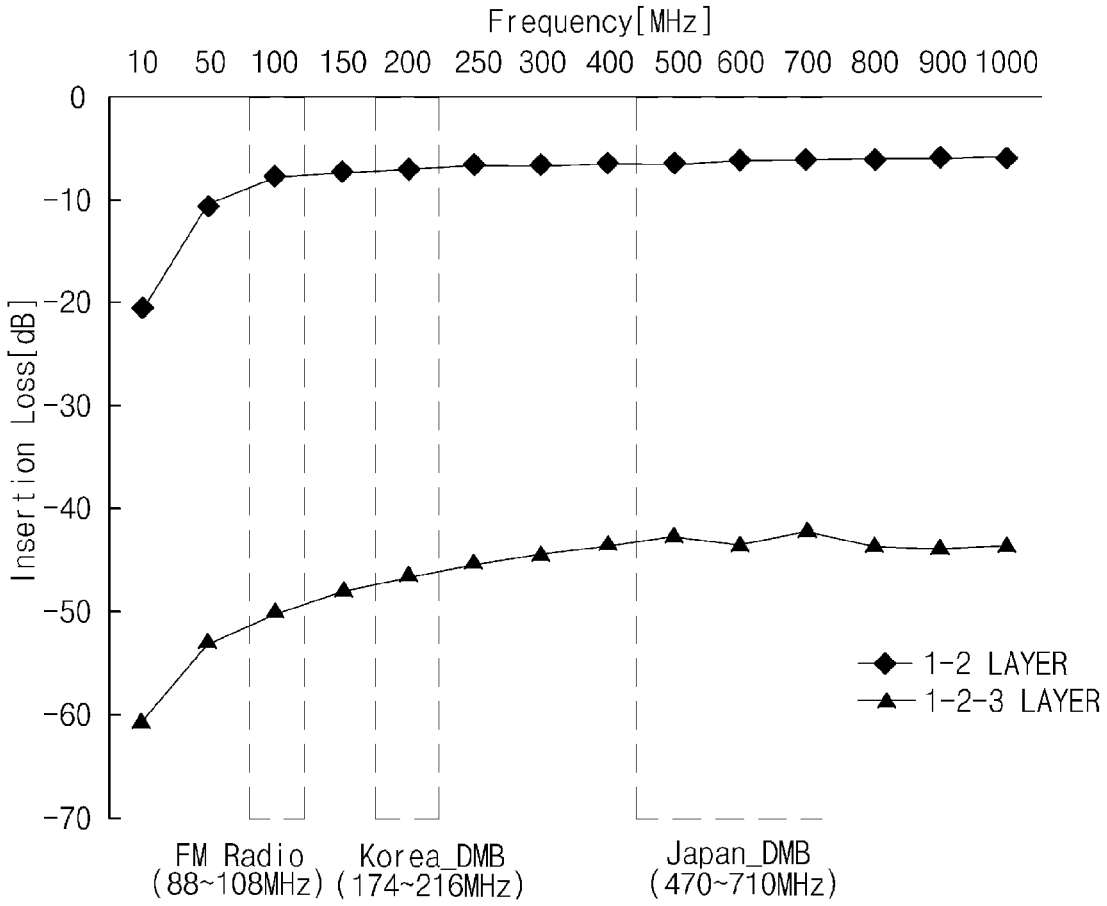
FIG. 19B is a view illustrating frequency characteristics of the structure having a plurality of couplers, according to an embodiment of the present disclosure.

FIG. 19B is a view illustrating frequency characteristics of the structure having a plurality of couplers, according to an embodiment of the present disclosure.

Referring to FIG. 19B, it may be seen that the insertion loss of the coupling structure of type A4 described in FIG. 19A is lower than that of the coupling structure of type B4. Based on the result of the graph, it may be predicted that the coupling structure of type B4 causes a mutual interference in the process of coupling a wireless signal flowing through the ground line 126 by the first coupler 127 and the second coupler 127. Further, it may be predicted that the second coupler 127 acts as an interference in the coupling process of the first coupler 127 or the first coupler 127 acts as an interference in the coupling process of the second coupler 127. As described above, as compared with the case in which a coupler is arranged in a plurality of layers, it may be advantageous to form a coupling structure in a form in which a ground line and a coupler are paired.

As described above, in the coupling structure of the substrate 120 according to an embodiment of the present disclosure, when the length and the area of the coupler 127 are formed to be larger while the ground line 126 and the coupler 127 are arranged to be relatively close, the insertion loss may be advantageously reduced.

According to an embodiment of the present disclosure, an earphone interface may include a plug housing into which an earphone plug is inserted and comprising contact points that contact electrode terminals of the earphone plug and protrusions that are connected to the contact points, respectively and a substrate having signal lines that are coupled to the protrusions arranged in the plug housing to transmit signals to the electrode terminals of the earphone plug or receive signals from a specific electrode terminal, wherein the substrate may include a ground line that is connected to a ground terminal of the earphone plug and a coupler that couples a wireless signal that flows through the ground line.

According to an embodiment of the present disclosure, the substrate may include a contact point connecting area in which connection holes connected to the protrusions are arranged, a coupling extension area that extends from a first side to a second side of the contact point connecting area and in which the ground line and the coupler are arranged, a bending area that is arranged adjacent to the contact point connecting area (or extends from the contact point connecting area) and in which lines connected to the connection holes, the ground line, and the coupler are arranged and a substrate connecting area that is adjacent to the bending area (or extends from the bending area) and in which extension lines of the lines arranged in the bending area are arranged, ends of the extending lines having pad shapes, respectively.

According to an embodiment of the present disclosure, the substrate may include a plurality of layers, the ground line is formed in a first layer, and the coupler is formed in a second layer that is adjacent to the first layer.

According to an embodiment of the present disclosure, the ground line formed in the first layer and the coupler formed in the second layer may be parallel.

According to an embodiment of the present disclosure, parts of the ground line and the coupler formed in the coupling extension area may have patterns, respectively.

According to an embodiment of the present disclosure, a part of the ground line and the coupler, which is arranged on the coupling extension area, may have a zigzag pattern.

According to an embodiment of the present disclosure, the patterns may have the same width, and an interval between the patterns may be not less than three times as wide as the width of the pattern.

According to an embodiment of the present disclosure, the earphone interface may include a protection part that is arranged on one side of the contact point connecting area to prevent an overvoltage condition.

According to an embodiment of the present disclosure, at least one of the coupling extension area and the bending area may be formed as a flexible type.

According to an embodiment of the present disclosure, the ground line and the coupler may be disposed in the same layer.

Figure 20:
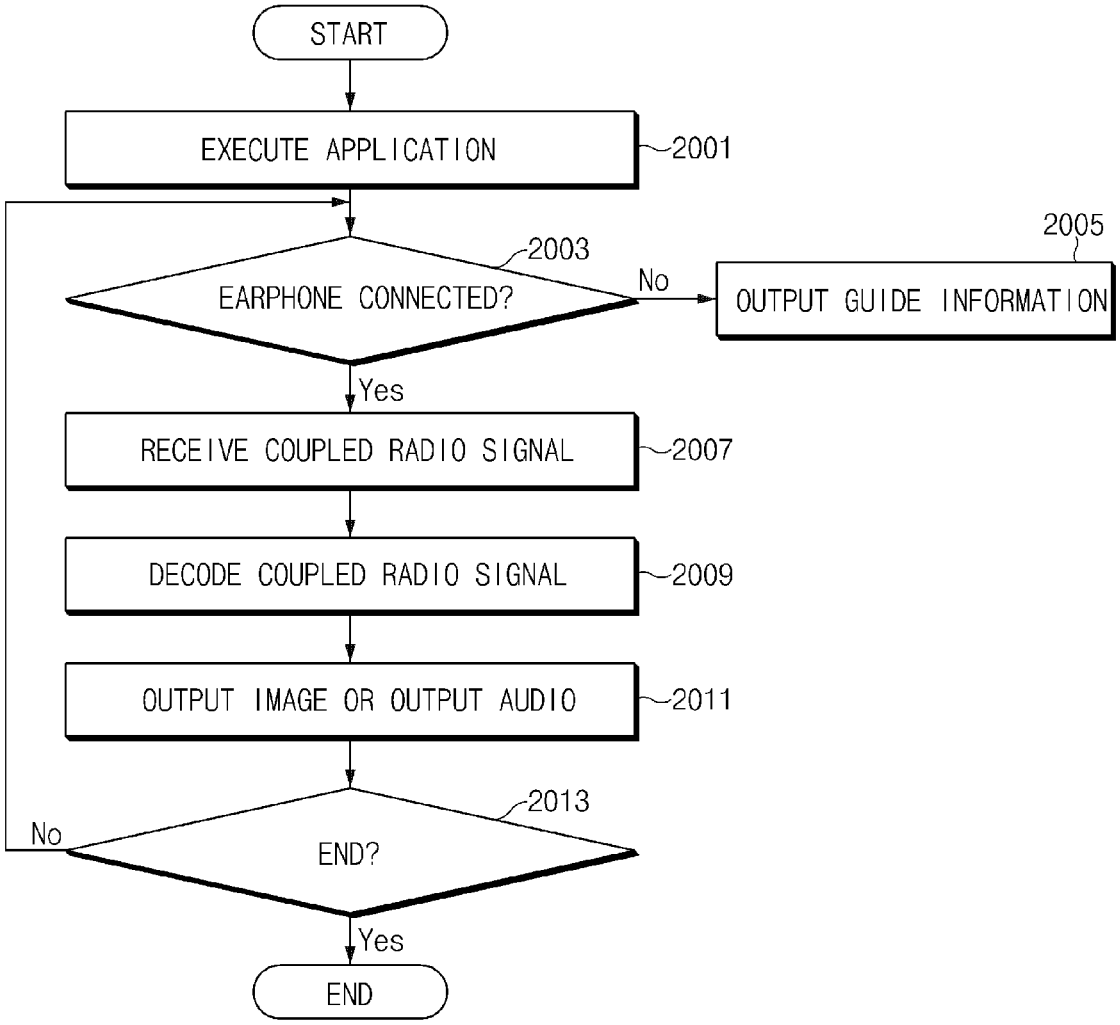
FIG. 20 is a flowchart illustrating a wireless signal processing operation of an electronic device, according to an embodiment of the present disclosure.

FIG. 20 is a flowchart illustrating a wireless signal processing operation of an electronic device, according to an embodiment of the present disclosure.

Referring to FIG. 20, in relation to a wireless signal processing operation of the electronic device, in Step 2001, a processor of the electronic device may execute an application in response to a user input or a scheduling event. For example, the processor of the electronic device may execute a multimedia broadcast receiving function. Further, the processor of the electronic device may execute a radio function.

In step 2003, the processor identifies a connection state of an earphone. When the earphone is not connected, the processor outputs guide information, in step 2005. The guide information, for example, may include at least one of visual information or audio information including content that requests connection of the earphone. In the operation, the processor may disable an application (for example, a multimedia broadcast receiving function or a radio function) if the earphone is not connected.

If the earphone is connected, the processor may receive a coupled wireless signal in response to a signal flowing through a ground terminal of an earphone and a ground line of a substrate in step 2007. In this regard, the substrate may include a coupler for coupling a signal of the ground line. The coupler may be electrically connected to a printed circuit board that is electrically connected to the processor.

In step 2009, the process may decode a coupled wireless signal. In operation, the processor may differently decode wireless signals according to the type of application. For example, when the radio function is executed, the processor may perform audio-decoding for the coupled wireless signal. When the multimedia broadcast receiving function is executed, the processor may perform video-decoding and audio-decoding for the coupled wireless signal.

In step 2011, the processor performs at least one of output of an image or output of an audio. For example, when the radio function is executed, the processor may transfer the decoded audio to the audio processing module to output the decoded audio to the earphone. When the multimedia broadcast receiving function is executed, the processor may output the decoded audio to the earphone through the audio processing module and transfer the decoded video to the display.

In step 2013, the processor identifies a completion state of an application. For example, the processor may determine that the application has ended when a user input related to the completion of the application is generated, electric power is interrupted, or the earphone is separated. When an event related to the completion of an application is not generated, the processor returns to the operations before step 2003 to perform the operations again.

Meanwhile, although an earphone interface having a form including a plug housing and a substrate coupled to the plug housing has been exemplified in the above description, the present disclosure is not limited thereto. For example, the earphone interface according to the present disclosure may include a plug housing into which the earphone plug is inserted and including contact points to which electrode terminals (for example, a ground terminal, a left audio output terminal, a right audio output terminal, and a microphone terminal) of the earphone plug are electrically connected, and a printed circuit board that is coupled to the contact points of the plug housing. For example, the audio processing module and the wireless signal processing module, which have been described above, may be mounted on the printed circuit board. Further, the ground line and the coupler, which have been described above, may be arranged in the printed circuit board. The ground line may be electrically connected to one of the contact points of the plug housing, which is connected to the ground terminal, and may be connected to the audio processing module. The coupler may be arranged to be physically spaced apart from the ground line, one side of the coupler may be arranged in a floating state, and an opposite side of the coupler may be connected to the wireless signal processing module. The coupler and the ground line may be formed on layers of a plurality of layers of the printed circuit board, and may be formed in different layers to maintain an interval therebetween. Further, the coupler and the ground line may be disposed in the same layer of the printed circuit board, and may be arranged in the same layer to be spaced apart from each other by a specific interval.

As described above, the electronic device according to an embodiment of the present disclosure may include an earphone interface that includes contact points in contact with a plurality of electrode terminals of an earphone plug, a ground line that is connected to one of the contact points, which is connected to a ground terminal of the earphone plug, an audio processing module that is electrically connected to the ground line, a coupler that is arranged to be spaced apart from the ground line at an interval, and a wireless signal processing module that is electrically connected to the coupler to process a wireless signal coupled by the coupler.

According to various embodiments, at least a portion of the ground line and at least a portion of the coupler may be formed on a printed circuit board, on which the audio processing module or the wireless signal processing module is mounted.

As described above, according to various embodiments, characteristics of an audio signal that is input and output through an earphone may be reinforced by physically separating a line that uses an earphone as an antenna and a ground line related to input and output of an audio.

Further, according to various embodiments of the present disclosure, the space required for components may be efficiently designed by deleting components related to a branch circuit of an electronic device.

Figure 21:
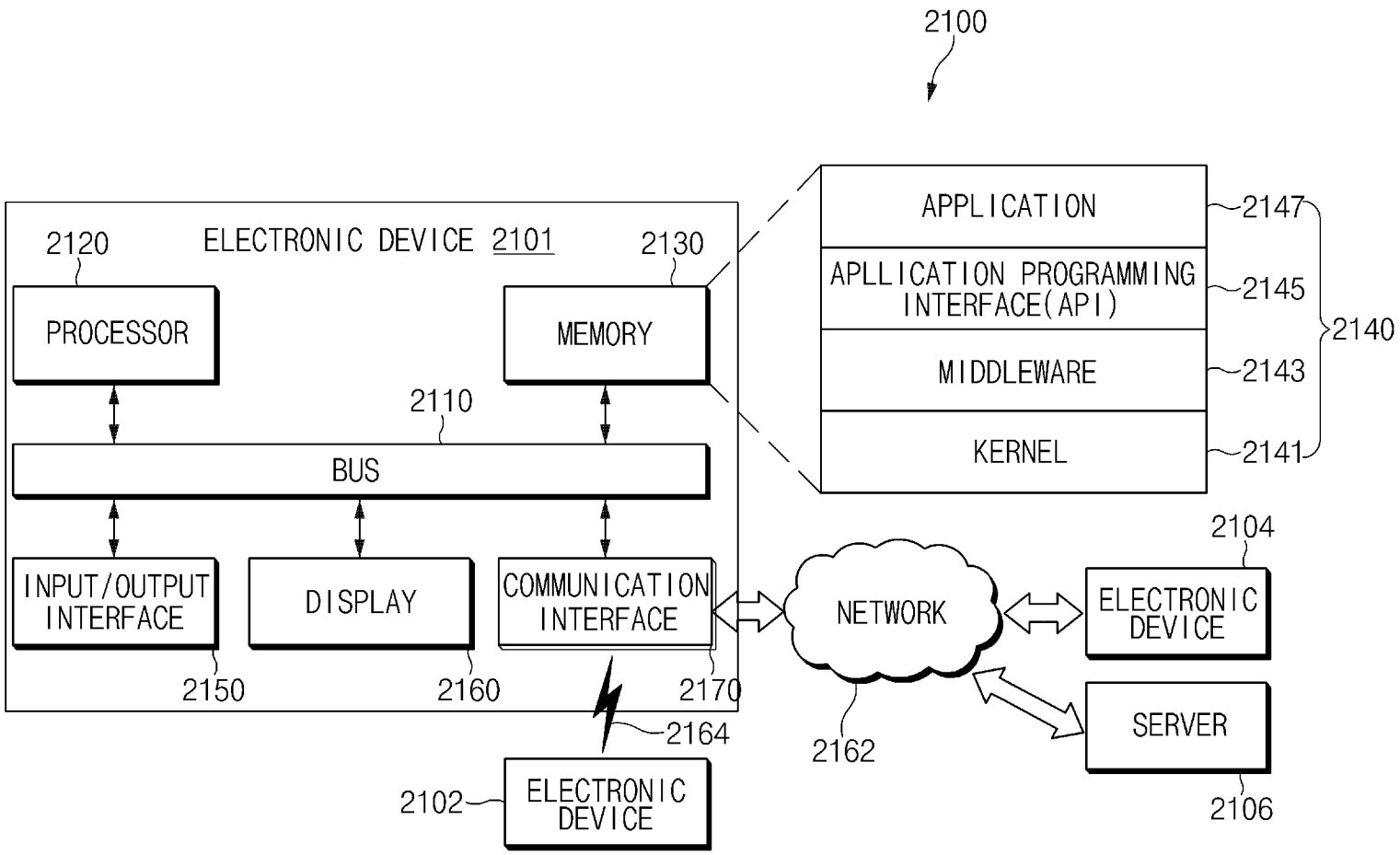
FIG. 21 is a block diagram illustrating an electronic device operating environment, according to an embodiment of the present disclosure of the present disclosure.

FIG. 21 is a diagram illustrating an electronic device operating environment, according to an embodiment of the present disclosure of the present disclosure.

Referring to FIG. 21, in an electronic device operating environment 2100, an electronic device 2101, 2102 or 2104 of various embodiments of the present disclosure or a server 2106 may be connected to each other via a network 2162 or short-range communications. The electronic device 2101 includes a bus 2110, a processor 2120, a memory 2130, an input/output interface 2150, a display 2160, and a communication interface 2170. In various embodiments of the present disclosure, at least one of the foregoing elements may be omitted or another element may be added to the electronic device 2101.

The bus 2110 may include a circuit for connecting the above-mentioned elements 2110 to 2170 to each other and transferring communications (e.g., control messages and/or data) among the above-mentioned elements.

The processor 2120 may include at least one of a CPU, an AP, and a communication processor (CP). The processor 2120 may perform data processing or an operation related to communication and/or control of at least one of the other elements of the electronic device 2101.

The memory 2130 may include a volatile memory and/or a nonvolatile memory. The memory 2130 may store instructions or data related to at least one of the other elements of the electronic device 2101. Memory 2130 may store software and/or a program 2140. The program 2140 includes, for example, a kernel 2141, a middleware 2143, an application programming interface (API) 2145, and/or an application program (or an application) 2147. At least a portion of the kernel 2141, the middleware 2143, or the API 2145 may be referred to as an operating system (OS).

The kernel 2141 may control or manage system resources (e.g., the bus 2110, the processor 2120, the memory 2130, and the like) used to perform operations or functions of other programs (e.g., the middleware 2143, the API 2145, or the application program 2147). Furthermore, the kernel 2141 may provide an interface for allowing the middleware 2143, the API 2145, or the application program 2147 to access individual elements of the electronic device 2101 in order to control or manage the system resources.

The middleware 2143 may serve as an intermediary so that the API 2145 or the application program 2147 communicates and exchanges data with the kernel 2141.

Furthermore, the middleware 2143 may handle one or more task requests received from the application program 2147 according to a priority order. For example, the middleware 2143 may assign at least one application program 2147 a priority for using the system resources (e.g., the bus 2110, the processor 2120, the memory 2130, and the like) of the electronic device 2101. For example, the middleware 2143 may handle the one or more task requests according to the priority assigned to the at least one application, thereby performing scheduling or load balancing with respect to the one or more task requests.

The API 2145, which is an interface for allowing the application 2147 to control a function provided by the kernel 2141 or the middleware 2143, may include, for example, at least one interface or function (e.g., instructions) for file control, window control, image processing, character control, and the like.

The input/output interface 2150 may serve to transfer an instruction or data input from a user or another external device to another element(s) of the electronic device 2101. Furthermore, the input/output interface 2150 may output instructions or data received from another element(s) of the electronic device 2101 to the user or another external device.

The display 2160 may include, for example, a liquid crystal display (LCD), a light emitting diode (LED) display, an organic light emitting diode OLED display, a microelectromechanical systems (MEMS) display, or an electronic paper display. The display 2160 may present various content (e.g., a text, an image, a video, an icon, a symbol, and the like) to the user. The display 2160 may include a touch screen, and may receive a touch, gesture, proximity or hovering input from an electronic pen or a part of a body of the user.

The communication interface 2170 may set communications between the electronic device 2101 and a first external electronic device 2102, a second external electronic device 2102 or the server 2106. For example, the communication interface 2170 may be connected to the network 2162 via wireless or wired communications so as to communicate with the external device (e.g., the server 2106). For example, the communication interface 2170 may be connected to a first electronic device 2102 directly via a wired or wireless connection 2164.

The wireless communications may employ at least one of cellular communication protocols such as long-term evolution (LTE), LTE-advanced (LTE-A), code division multiple access (CDMA), wideband CDMA (WCDMA), universal mobile telecommunications system (UMTS), wireless broadband (WiBro), and global system for mobile communications (GSM). Furthermore, the wireless communications may include, for example, short-range communications. The short-range communications may include at least one of wireless fidelity (Wi-Fi), Bluetooth, near field communication (NFC), magnetic stripe transmission (MST), and global navigation satellite system (GNSS).

The MST may generate pulses according to transmission data using electromagnetic signals, and the pulses may generate magnetic signals. The electronic device 2101 may transmit the magnetic signals to a POS, and the POS may detect the magnetic signals using an MST reader, and may convert detected magnetic signals into electric signals to thereby restore the data.

The GNSS may include, for example, at least one of global positioning system (GPS), global navigation satellite system (GLONASS), BeiDou navigation satellite system (BeiDou), and Galileo, the European global satellite-based navigation system according to a use area or a bandwidth. Hereinafter, the term "GPS" and the term "GNSS" may be interchangeably used. The wired communications may include at least one of universal serial bus (USB), high definition multimedia interface (HDMI), recommended standard 232 (RS-232), plain old telephone service (POTS), and the like. The network 2162 may include at least one of telecommunications networks, for example, a computer network (e.g., a local area network (LAN) or wide area network (WAN)), the Internet, and a telephone network.

The type of the first external electronic device 2102 or the second external electronic device 2104 may be the same as or different from that of the electronic device 2101. In some cases, server 2106 may include a group of one or more servers. In various embodiments, a portion or all of operations performed in the electronic device 2101 may be performed in one or more of the electronic device 2102, 2104 or the server 2106. In a case where the electronic device 2101 is required to perform a certain function or service automatically or in response to a request, the electronic device 2101 may request at least a portion of functions related to the function or service from the electronic device 2102, 2104 or the server 2106, instead of or in addition to performing the function or service for itself. The electronic device 2102, 2104 or the server 2106 may perform the requested function or additional function, and may transfer a result of the performance to the electronic device 2101. The electronic device 2101 may use or additionally process a received result to provide the requested function or service. To this end, for example, a cloud computing technology, a distributed computing technology, or a client-server computing technology may be used.

Figure 22:
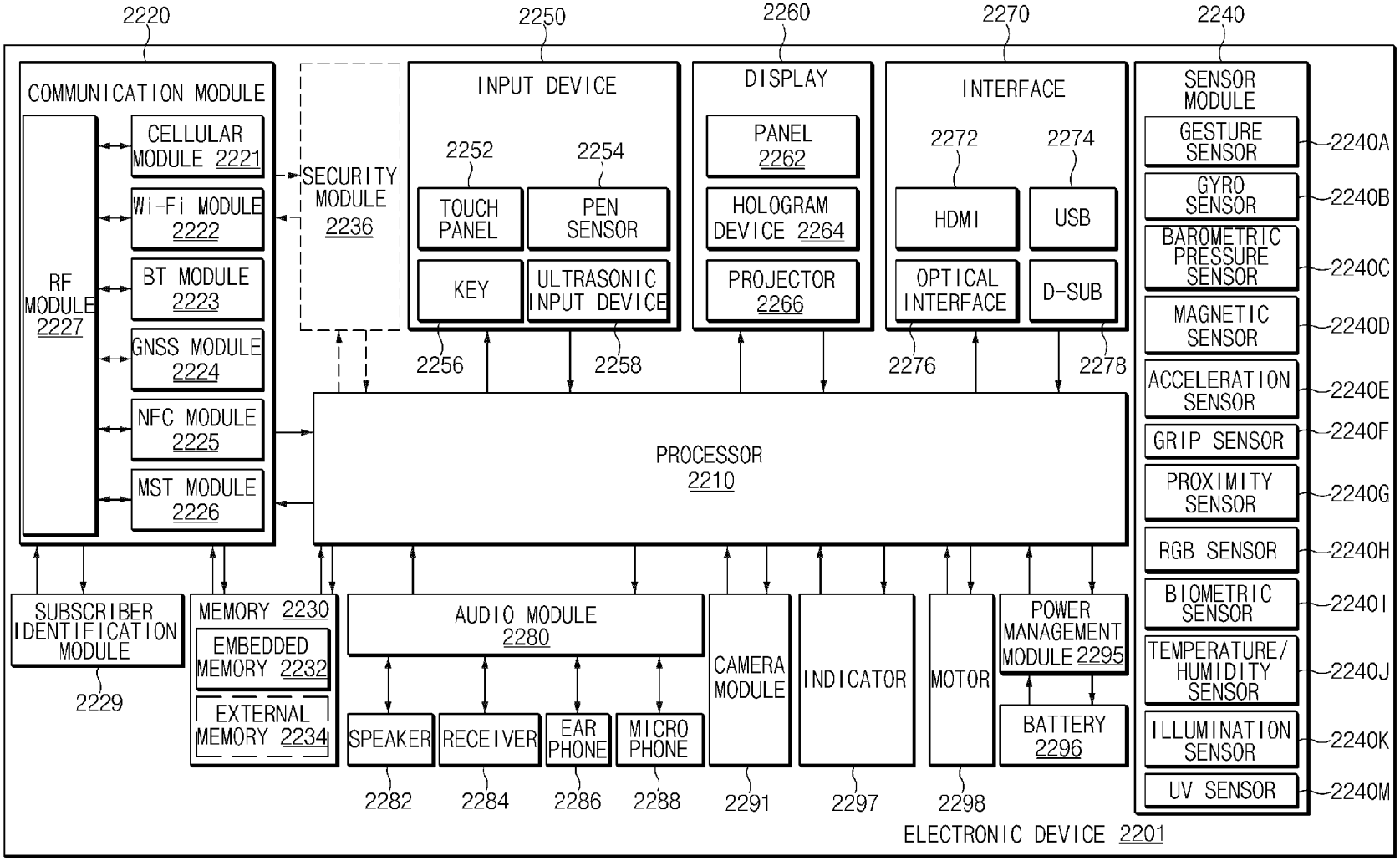
FIG. 22 is a block diagram illustrating an electronic device, according to various embodiments of the present disclosure.

FIG. 22 is a block diagram illustrating an electronic device 2201 according to various embodiments of the present disclosure. The electronic device 2201 may include, for example, a part or the entirety of the electronic devices 100 of FIG. 1 and the electronic device 2101 of FIG. 21. The electronic device 2201 includes at least one processor (e.g., an application processor (AP)) 2210, a communication module 2220, a subscriber identification module 2229, a memory 2230, a sensor module 2240, an input device 2250, a display 2260, an interface 2270, an audio module 2280, a camera module 2291, a power management module 2295, a battery 2296, an indicator 2297, and a motor 2298.

The processor 2210 may run an operating system or an application program so as to control a plurality of hardware or software elements connected to the processor 2210, and may process various data and perform operations. The processor 2210 may be implemented with, for example, a system on chip (SoC). According to an embodiment of the present disclosure, the processor 2210 may further include a graphic processing unit (GPU) and/or an image signal processor. The processor 2210 may load, on a volatile memory, an instruction or data received from at least one of other elements (e.g., a nonvolatile memory) to process the instruction or data, and may store various data in a nonvolatile memory.

The communication module 2220 includes, for example, a cellular module 2221, a Wi-Fi module 2222, a Bluetooth module 2223, a GNSS module 2224 (e.g., a GPS module, a GLONASS module, a BeiDou module, or a Galileo module), an NFC module 2225, an MST module 2226, and a radio frequency (RF) module 2227.

The cellular module 2221 may provide, for example, a voice call service, a video call service, a text message service, or an Internet service through a communication network. Cellular module 2221 may identify and authenticate the electronic device 2201 in the communication network using the subscriber identification module 2224 (e.g., a SIM card). Cellular module 2221 may perform at least a part of functions providable by the processor 2210. Cellular module 2221 may include a communication processor (CP).

Each of the Wi-Fi module 2222, the Bluetooth module 2223, the GNSS module 2224, the NFC module 2225, and the MST module 2226 may include, for example, a processor for processing data transmitted/received through the modules. In some cases, at least a portion (e.g., at least two) of the cellular module 2221, the Wi-Fi module 2222, the Bluetooth module 2223, the GNSS module 2224, the NFC module 2225, and the MST module 2226 may be included in a single integrated chip (IC) or IC package.

The RF module 2227 may transmit/receive, for example, communication signals (e.g., RF signals). The RF module 2227 may include, for example, a transceiver, a power amp module (PAM), a frequency filter, a low noise amplifier (LNA), an antenna, and the like. According to an embodiment of the present disclosure, at least one of the cellular module 2221, the Wi-Fi module 2222, the Bluetooth module 2223, the GNSS module 2224, the NFC module 2225, or the MST module 2226 may transmit/receive RF signals through a separate RF module.

The subscriber identification module 2229 may include, for example, an embedded SIM and/or a card containing a subscriber identification module, and may include unique identification information (e.g., an integrated circuit card identifier (ICCID)) or subscriber information (e.g., international mobile subscriber identity (IMSI)).

The memory 2230 includes an internal memory 2232 or an external memory 2234. The internal memory 2232 may include at least one of a volatile memory (e.g., a dynamic RAM (DRAM), a static RAM (SRAM), a synchronous dynamic RAM (SDRAM), and the like) or a nonvolatile memory (e.g., a one-time programmable ROM (OTPROM), a programmable ROM (PROM), an erasable and programmable ROM (EPROM), an electrically erasable and programmable ROM (EEPROM), a mask ROM, a flash ROM, a flash memory (e.g., a NAND flash memory, a NOR flash memory, and the like), a hard drive, or a solid state drive (SSD)).

The external memory 2234 may include a flash drive, for example, compact flash (CF), secure digital (SD), micro secure digital (Micro-SD), mini secure digital (Mini-SD), extreme digital (xD), multi-media card (MMC), a memory stick, and the like. The external memory 2234 may be operatively and/or physically connected to the electronic device 2201 through various interfaces.

The sensor module 2240 may, for example, measure physical quantity or detect an operation state of the electronic device 2201 so as to convert measured or detected information into an electrical signal. The sensor module

2240 includes, for example, at least one of a gesture sensor 2240A, a gyro sensor 2240B, a barometric pressure sensor 2240C, a magnetic sensor 2240D, an acceleration sensor 2240E, a grip sensor 2240F, a proximity sensor 2240G, a color sensor 2240H (e.g., a red/green/blue (RGB) sensor), a biometric sensor 2240I, a temperature/humidity sensor 2240J, an illumination sensor 2240K, or an ultraviolet (UV) sensor 2240M. Additionally or alternatively, the sensor module 2240 may include, for example, an olfactory sensor (E-nose sensor), an electromyography (EMG) sensor, an electroencephalogram (EEG) sensor, an electrocardiogram (ECG) sensor, an infrared (IR) sensor, an iris sensor, and/or a fingerprint sensor. The sensor module 2240 may further include a control circuit for controlling at least one sensor included therein. In some various embodiments of the present disclosure, the electronic device 2201 may further include a processor configured to control the sensor module 2240 as a part of the processor 2210 or separately, so that the sensor module 2240 is controlled while the processor 2210 is in a sleep state.

The input device 2250 includes, for example, a touch panel 2252, a (digital) pen sensor 2254, a key 2256, or an ultrasonic input device 2258. The touch panel 2252 may employ at least one of capacitive, resistive, infrared, and ultraviolet sensing methods. The touch panel 2252 may further include a control circuit. The touch panel 2252 may further include a tactile layer so as to provide a haptic feedback to a user.

The (digital) pen sensor 2254 may include, for example, a sheet for recognition which is a part of a touch panel or is separate. The key 2256 may include, for example, a physical button, an optical button, or a keypad. The ultrasonic input device 2258 may sense ultrasonic waves generated by an input tool through a microphone 2288 so as to identify data corresponding to the ultrasonic waves sensed.

The display 2260 (e.g., the display 160 or the display 2160) includes a panel 2262, a hologram device 2264, or a projector 2266. The panel 2262 may have a configuration that is the same as or similar to that of the display 2160 of FIG. 21. The panel 2262 may be, for example, flexible, transparent or wearable. The panel 2262 and the touch panel 2252 may be integrated into a single module. The hologram device 2264 may display a stereoscopic image in a space using a light interference phenomenon. The projector 2266 may project light onto a screen so as to display an image. The screen may be disposed in the inside or the outside of the electronic device 2201. Display 2260 may further include a control circuit for controlling the panel 2262, the hologram device 2264, or the projector 2266.

The interface 2270 includes, for example, a high-definition multimedia interface (HDMI) 2272, a universal serial bus (USB) 2274, an optical interface 2276, or a D-subminiature (D-sub) 2278. Additionally or alternatively, the interface 2270 may include, for example, a mobile high-definition link (MHL) interface, a secure digital (SD) card/multimedia card (MMC) interface, or an infrared data association (IrDA) interface.

The audio module 2280 may convert, for example, a sound into an electrical signal or vice versa. The audio module 2280 may process sound information input or output through a speaker 2282, a receiver 2284, an earphone 2286, or the microphone 2288.

Camera module 2291 for shooting a still image or a video may include, for example, at least one image sensor (e.g., a front sensor or a rear sensor), a lens, an image signal processor (ISP), or a flash (e.g., an LED or a xenon lamp).

The power management module 2295 may manage power of the electronic device 2201. According to an embodiment of the present disclosure, the power management module 2295 may include a power management integrated circuit (PMIC), a charger integrated circuit (IC), or a battery gauge. The PMIC may employ a wired and/or wireless charging method. The wireless charging method may include, for example, a magnetic resonance method, a magnetic induction method, an electromagnetic method, and the like. An additional circuit for wireless charging, such as a coil loop, a resonant circuit, a rectifier, and the like, may be further included. The battery gauge may measure, for example, a remaining charge capacity of the battery 2296 and a voltage, current or temperature thereof while the battery is charged. The battery 2296 may include, for example, a rechargeable battery and/or a solar battery.

The indicator 2297 may display a specific state of the electronic device 2201 or a part thereof (e.g., the processor 2210), such as a booting state, a message state, a charging state, and the like. The motor 2298 may convert an electrical signal into a mechanical vibration, and may output (or generate) a vibration or haptic effect. A processing device (e.g., a GPU) for supporting mobile TV may be included in the electronic device 2201. The processing device for supporting mobile TV may process media data according to the standards of digital multimedia broadcasting (DMB), digital video broadcasting (DVB), MediaFLO™, and the like.

Each of the elements described herein may be configured with one or more components, and the names of the elements may be changed according to the type of an electronic device. In various embodiments of the present disclosure, an electronic device may include at least one of the elements described herein, and some elements may be omitted or other additional elements may be added. Furthermore, some of the elements of the electronic device may be combined with each other so as to form one entity, so that the functions of the elements may be performed in the same manner as before the combination.

Figure 23:
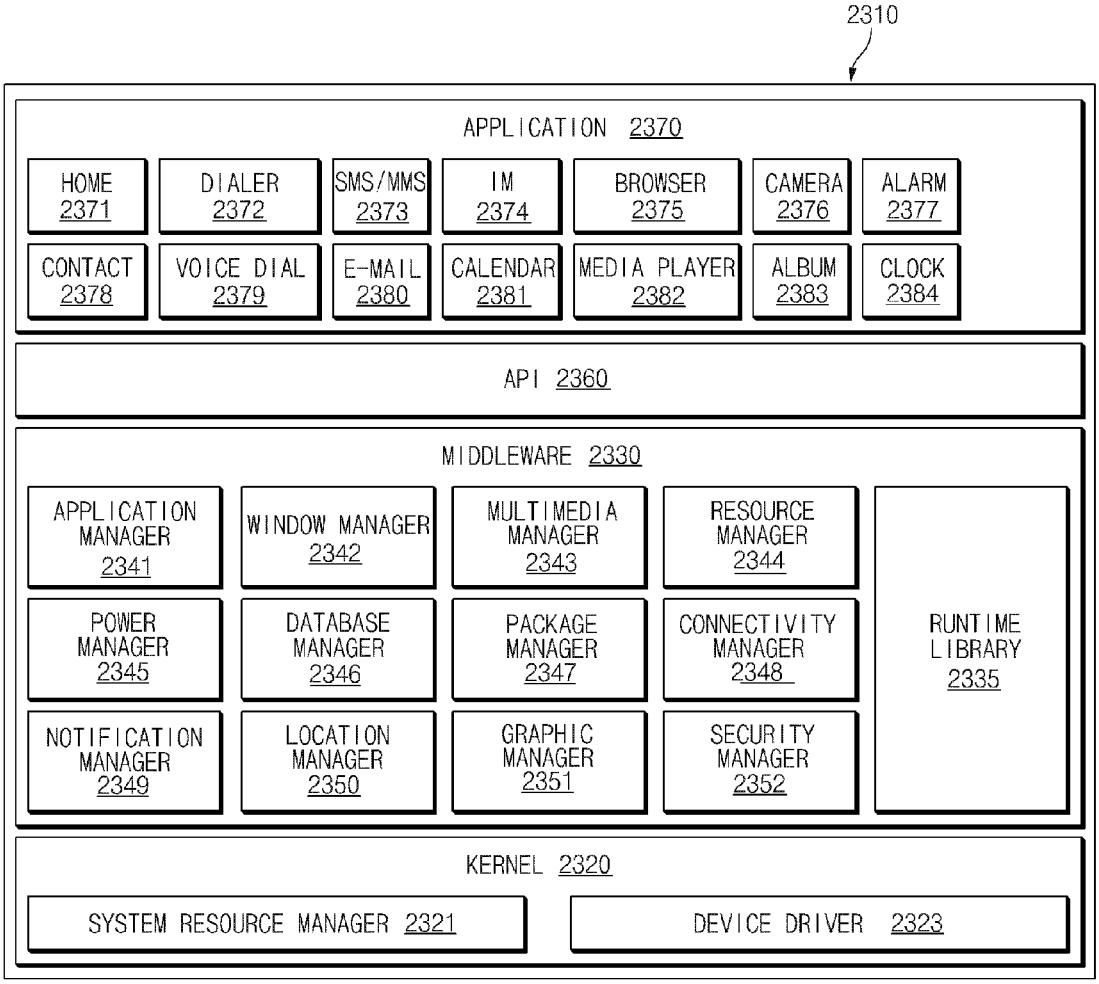
FIG. 23 is a block diagram illustrating a program module, according to various embodiments of the present disclosure.

FIG. 23 is a block diagram illustrating a program module according to various embodiments of the present disclosure. According to an embodiment of the present disclosure, a program module 2310 may include an operating system (OS) for controlling a resource related to an electronic device (e.g., the electronic device 100, the electronic device 2101, or the electronic device 2201) and/or various applications running on the OS. The operating system may be, for example, Android, iOS, Windows, Symbian, Tizen, Bada, and the like.

The program module 2310 includes a kernel 2320, a middleware 2330, an application programming interface (API) 2360, and/or an application 2370. At least a part of the program module 2310 may be preloaded on the electronic device or may be downloaded from an external electronic device.

The kernel 2320 includes, for example, a system resource manager 2321 and/or a device driver 2323. The system resource manager 2321 may perform control, allocation, or retrieval of a system resource. According to an embodiment of the present disclosure, the system resource manager 2321 may include a process management unit, a memory management unit, a file system management unit, and the like. The device driver 2323 may include, for example, a display driver, a camera driver, a Bluetooth driver, a shared memory driver, a USB driver, a keypad driver, a Wi-Fi driver, an audio driver, or an inter-process communication (IPC) driver.

The middleware 2330, for example, may provide a function that the applications 2370 require in common, or may provide various functions to the applications 2370 through the API 2360 so that the applications 2370 may efficiently use limited system resources in the electronic device. Middleware 2330 includes at least one of a runtime library 2335, an application manager 2341, a window manager 2342, a multimedia manager 2343, a resource manager 2344, a power manager 2345, a database manager 2346, a package manager 2347, a connectivity manager 2348, a notification manager 2349, a location manager 2350, a graphic manager 2351, or a security manager 2352.

The runtime library 2335 may include, for example, a library module that a compiler uses to add a new function through a programming language while the application 2370 is running. The runtime library 2335 may perform a function for input/output management, memory management, or an arithmetic function.

The application manager 2341 may mange, for example, a life cycle of at least one of the applications 2370. The window manager 2342 may manage a GUI resource used in a screen. The multimedia manager 2343 may recognize a format required for playing various media files and may encode or decode a media file using a codec matched to the format. The resource manager 2344 may manage a resource such as a source code, a memory, or a storage space of at least one of the applications 2370.

The power manager 2345, for example, may operate together with a basic input/output system (BIOS) to manage a battery or power and may provide power information required for operating the electronic device. The database manager 2346 may generate, search, or modify a database to be used in at least one of the applications 2370. The package manager 2347 may manage installation or update of an application distributed in a package file format.

The connectivity manger 2348 may manage wireless connection of Bluetooth, and the like. The notification manager 2349 may display or notify an event such as message arrival, appointments, and proximity alerts in such a manner as not to disturb a user. The location manager 2350 may manage location information of the electronic device. The graphic manager 2351 may manage a graphic effect to be provided to a user or a user interface related thereto. The security manager 2352 may provide various security functions required for system security or user authentication. According to an embodiment of the present disclosure, in the case in which an electronic device (e.g., the electronic device 100 or the electronic device 2101) includes a phone function, the middleware 2330 may further include a telephony manager for managing a voice or video call function of the electronic device.

The middleware 2330 may include a middleware module for forming a combination of various functions of the above-mentioned elements. The middleware 2330 may provide a module specialized for each type of an operating system to provide differentiated functions. Furthermore, the middleware 2330 may delete a part of existing elements or may add new elements dynamically.

The API 2360 which is, for example, a set of API programming functions may be provided in different configurations according to an operating system. For example, in the case of Android or iOS™, one API set may be provided for each platform, and, in the case of Tizen™, at least two API sets may be provided for each platform.

The application 2370, for example, includes at least one application for providing functions such as a home 2371, a dialer 2372, an SMS/MMS 2373, an instant message (IM) 2374, a browser 2375, a camera 2376, an alarm 2377, a contact 2378, a voice dial 2379, an e-mail 2380, a calendar 2381, a media player 2382, an album 2383, a clock 2384, health care (e.g., measure an exercise amount or blood sugar level), or environmental information provision (e.g., provide air pressure, humidity, or temperature information).

Application 2370 may include an information exchange application for supporting information exchange between the electronic device 100 or the electronic device 2101 and an external electronic device. The information exchange application may include, for example, a notification relay application for relaying specific information to the external electronic device or a device management application for managing the external electronic device.

For example, the notification relay application may have a function for relaying, to an external electronic device, notification information generated in another application (e.g., an SMS/MMS application, an e-mail application, a health care application, an environmental information application, and the like) of the electronic device. Furthermore, the notification relay application may receive notification information from the external electronic device and may provide the received notification information to the user.

The device management application, for example, may manage (e.g., install, delete, or update) at least one function (e.g., turn-on/turn off of an external electronic device itself (or some elements) or the brightness (or resolution) adjustment of a display) of the external electronic device communicating with the electronic device, an application running in the external electronic device, or a service (e.g., a call service or a message service) provided from the external electronic device.

According to an embodiment of the present disclosure, the application 2370 may include a specified application (e.g., a healthcare application of a mobile medical device) according to an attribute of the external electronic device. The application 2370 may include an application received from the external electronic device. The application 2370 may include a preloaded application or a third-party application downloadable from a server. The names of the elements of the program module 2310 illustrated may vary with the type of an operating system.

According to various embodiments of the present disclosure, at least a part of the program module 2310 may be implemented with software, firmware, hardware, or a combination thereof. At least a part of the program module 2310, for example, may be implemented (e.g., executed) by a processor (e.g., the processor 2210). At least a part of the program module 2310 may include, for example, a module, a program, a routine, sets of instructions, or a process for performing at least one function.

According to various embodiments of the present disclosure, an electronic device may include an earphone interface comprising a plug housing comprising contact points that contact electrode terminals of the earphone plug and protrusions that are connected to the contact points, respectively, and a substrate comprising a ground line that is connected to a ground contact point of the plug housing, and a coupler that couples a wireless signal that flows through the ground line, an audio processing module that is electrically connected to the ground line and a wireless signal processing module that processes a wireless signal coupled by the coupler.

According to an embodiment of the present disclosure, the electronic device may include at least one of an audio processing module that comprises a ground area of the audio processing module of the ground line or a processor that processes an output signal of the wireless signal processing module.

According to an embodiment of the present disclosure, an electronic device may include an earphone interface that comprises contact points in contact with a plurality of electrode terminals of an earphone plug, a ground line that is connected to one of the contact points, which is connected to a ground terminal of the earphone plug, an audio processing module that is electrically connected to the ground line, a coupler that is arranged to be spaced apart from the ground line at an interval and a wireless signal processing module that is electrically connected to the coupler to process a wireless signal coupled by the coupler.

The term "module" as used herein may represent, for example, a unit including one of hardware, software and firmware or a combination thereof. The term "module" may be interchangeably used with the terms "unit", "logic", "logical block", "component" and "circuit". The "module" may be a minimum unit of an integrated component or may be a part thereof. The "module" may be a minimum unit for performing one or more functions or a part thereof. The "module" may be implemented mechanically or electronically. For example, the "module" may include at least one of an application-specific integrated circuit (ASIC) chip, a field-programmable gate array (FPGA), and a programmable-logic device for performing some operations, which are known or will be developed.

At least a part of devices (e.g., modules or functions thereof) or methods (e.g., operations) according to various embodiments of the present disclosure may be implemented as instructions stored in a computer-readable storage medium in the form of a program module. In the case where the instructions are performed by a processor (e.g., the processor 2120), the processor may perform functions corresponding to the instructions. The computer-readable storage medium may be, for example, the memory 2230.

A computer-readable recording medium may include a hard disk, a floppy disk, a magnetic medium (e.g., a magnetic tape), an optical medium (e.g., CD-ROM, digital versatile disc (DVD)), a magneto-optical medium (e.g., a floptical disk), or a hardware device (e.g., a ROM, a RAM, a flash memory, and the like). The program instructions may include machine language codes generated by compilers and high-level language codes that may be executed by computers using interpreters. The above-mentioned hardware device may be configured to be operated as one or more software modules for performing operations of various embodiments of the present disclosure and vice versa.

A module or a program module according to various embodiments of the present disclosure may include at least one of the above-mentioned elements, or some elements may be omitted or other additional elements may be added. Operations performed by the module, the program module or other elements according to various embodiments of the present disclosure may be performed in a sequential, parallel, iterative or heuristic way. Furthermore, some operations may be performed in another order or may be omitted, or other operations may be added.

The above embodiments of the present disclosure are illustrative and not limiting. Various alternatives and equivalents are possible. Other additions, subtractions, or modifications are obvious in view of the present disclosure and are intended to fall within the scope of the appended claims and their equivalents.

What is claimed is:

1. An earphone interface comprising:

a plug housing into which an earphone plug is inserted and comprising contact points that contact electrode terminals of the earphone plug and protrusions connected to the contact points; and a substrate having signal lines coupled to the protrusions arranged in the plug housing to transmit signals to the electrode terminals of the earphone plug or receive signals from a specific electrode terminal, wherein the substrate comprises:

a ground line connected to a ground terminal of the earphone plug; and a coupler that couples a wireless signal that flows through the ground line.

2. The earphone interface of claim 1, wherein the substrate further comprises:

a contact point connecting area in which connection holes connected to the protrusions are arranged;

a coupling extension area that extends from a first side to a second side of the contact point connecting area and in which the ground line and the coupler are arranged;

a bending area arranged adjacent to the contact point connecting area in which lines connected to the connection holes, the ground line, and the coupler are arranged; and a substrate connecting area adjacent to the bending area in which extension lines having pad shapes are arranged.

3. The earphone interface of claim 2, wherein the substrate further comprises a plurality of layers in which the ground line is formed in a first layer, and the coupler is formed in a second layer adjacent to the first layer.

4. The earphone interface of claim 3, wherein the ground line formed in the first layer and the coupler formed in the second layer are parallel.

5. The earphone interface of claim 2, wherein parts of the ground line and the coupler formed in the coupling extension area have patterns.

6. The earphone interface of claim 5, wherein a part of the ground line and the coupler have a zigzag pattern.

7. The earphone interface of claim 5, wherein the patterns have the same width, and an interval between the patterns is not less than three times as wide as the width of the patterns.

8. The earphone interface of claim 2, further comprising:

a protection part arranged on one side of the contact point connecting area to prevent an overvoltage condition.

9. The earphone interface of claim 2, wherein at least one of the coupling extension area and the bending area is formed as a flexible type.

10. The earphone interface of claim 2, wherein the ground line and the coupler are disposed in the same layer.

11. An electronic device comprising:

an earphone interface comprising a plug housing comprising contact points that contact electrode terminals of the earphone plug and protrusions connected to the contact points, and a substrate comprising a ground line connected to a ground contact point of the plug housing, and a coupler that couples a wireless signal that flows through the ground line;

an audio processing module electrically connected to the ground line; and a wireless signal processing module that processes a wireless signal coupled by the coupler.

12. The electronic device of claim 11, wherein the substrate further comprises:

a contact point connecting area in which connection holes connected to the protrusions are arranged;

a coupling extension area that extends from a first side to a second side of the contact point connecting area and in which the ground line and the coupler are arranged;

a bending area arranged adjacent to the contact point connecting area in which lines connected to the connection holes, the ground line, and the coupler are arranged; and a substrate connecting area adjacent to the bending area in which extension lines having pad shapes are arranged.

13. The electronic device of claim 12, wherein the substrate is further configured such that parts of the ground line and the coupler formed in the coupling extension area have patterns.

14. The electronic device of claim 13, wherein a part of the ground line and the coupler have a zigzag pattern.

15. The electronic device of claim 14, wherein the patterns have the same width, and an interval between the patterns is not less than three times as wide as the width of the patterns.

16. The electronic device of claim 12, wherein a protection part for preventing an overvoltage condition is arranged on one side of the contact point connecting area.

17. The electronic device of claim 12, wherein at least one of the coupling extension area and the bending area is formed as a flexible type.

18. The electronic device of claim 12, wherein the ground line and the coupler are disposed in the same layer.

19. The electronic device of claim 11, further comprising at least one of an audio processing module that comprises a ground area of the ground line and a processor that processes an output signal of the wireless signal processing module.

20. An electronic device comprising:

an earphone interface that comprises contact points in contact with a plurality of electrode terminals of an earphone plug;

a ground line connected to one of the contact points, which is connected to a ground terminal of the earphone plug;

an audio processing module electrically connected to the ground line;

a coupler arranged to be spaced apart from the ground line at an interval; and a wireless signal processing module electrically connected to the coupler to process a wireless signal coupled by the coupler.

* * * * *